US007066343B1

(12) United States Patent
Khachaturian

(10) Patent No.: US 7,066,343 B1
(45) Date of Patent: Jun. 27, 2006

(54) POWERED LIFTING APPARATUS USING MULTIPLE BOOMS

(76) Inventor: Jon E. Khachaturian, 5427 Sutton Pl., New Orleans, LA (US) 70131

( * ) Notice: Subject to any disclaimer, the term of this patent is extended or adjusted under 35 U.S.C. 154(b) by 378 days.

(21) Appl. No.: 10/635,238

(22) Filed: Aug. 5, 2003

Related U.S. Application Data

(63) Continuation-in-part of application No. 09/808,764, filed on Mar. 15, 2001, now Pat. No. 6,601,717, which is a continuation-in-part of application No. 09/460,479, filed on Dec. 14, 1999, now Pat. No. 6,213,319, which is a continuation of application No. 08/987,416, filed on Dec. 9, 1997, now Pat. No. 6,000,562, which is a continuation-in-part of application No. 08/780,846, filed on Dec. 9, 1996, now Pat. No. 5,836,463.

(51) Int. Cl.
*B66C 23/50* (2006.01)

(52) U.S. Cl. ..... 212/270; 212/271

(58) Field of Classification Search ..... 212/270, 212/271

See application file for complete search history.

(56) References Cited

U.S. PATENT DOCUMENTS

| | | | |
|---|---|---|---|
| 2,283,049 | A | 5/1942 | Cormier, Jr. |
| 2,344,390 | A | 3/1944 | Cohen |
| 2,572,336 | A | 10/1951 | Hall |
| 3,140,857 | A | 7/1964 | Nickles |
| 3,429,453 | A | 2/1969 | Kahle et al. |
| 3,671,013 | A | 6/1972 | Everson , Jr. et al. |
| 3,844,421 | A | 10/1974 | Nielsen |
| 4,041,875 | A | 8/1977 | Wallace |
| 4,218,045 | A | 8/1980 | Weismann |
| 4,354,193 | A | 10/1982 | Werner |
| 4,535,900 | A | 8/1985 | Daniell |
| 4,538,849 | A | 9/1985 | Khachaturian et al. |
| 5,836,463 | A | 11/1998 | Khachaturian |
| 6,000,562 | A | 12/1999 | Khachaturian |

(Continued)

FOREIGN PATENT DOCUMENTS

| | | |
|---|---|---|
| AT | 35848 | 8/1908 |

(Continued)

*Primary Examiner*—Thomas J. Brahan
(74) *Attorney, Agent, or Firm*—Garvey, Smith, Nehrbass & North, L.L.C.; Charles C. Garvey, Jr.

(57) ABSTRACT

A lifting apparatus includes a plurality of preferably four carriages, each carriage supporting a lifting boom. Two booms are pinned together to define a first pair, a second two booms being pinned together to define a second pair. Each pair of booms and connected carriages are placed on a preferably common travel path. Rigging can include a horizontal beam that extends between the first pair of booms and the second pair of booms. The beam can be attached to the pinned connection of each pair of booms with a sling. A powered motor-driven winch is used to power a cable that is wound between sheaves on the lower end portions of a pair of booms that are connected together. During use, the winches are simultaneously or nearly simultaneously operated to elevate the first pair of the booms and the second pair of booms at about the same time. The horizontal beam that spans in between booms is elevated. Packages can be lifted with the horizontal beam by depending one or more slings from the horizontal beam to the package to be lifted. The apparatus can use carriages that are provided with wheels that travel on rails. Carriages can use rubber tires, or can be sled or skid-mounted without the use of wheels or tires.

51 Claims, 24 Drawing Sheets

U.S. PATENT DOCUMENTS

| | | | |
|---|---|---|---|
| 6,213,319 | B1 | 4/2001 | Khachaturian |
| 6,601,717 | B1 | 8/2003 | Khachaturian |

FOREIGN PATENT DOCUMENTS

| | | |
|---|---|---|
| DE | 914238 | 6/1954 |
| DE | 915497 | 7/1954 |
| FR | 1280095 | 11/1961 |
| GB | 453980 | 9/1936 |
| GB | 1012-509 | 12/1965 |
| SU | 244580 | 5/1969 |
| SU | 303282 | 5/1971 |
| SU | 360313 | 11/1972 |
| SU | 1248942 | 8/1986 |
| SU | 1337339 | 9/1987 |
| SU | 1512919 | 10/1989 |
| SU | 1636325 | 3/1991 |
| SU | 1687566 | 10/1991 |
| WO | WO-90/00150 | 1/1990 |

10A
11
12
13
14
15
15A
15B
16
17
17A
17B
18
19
20
21
23
24
24A
25
30
31
45
46
48
53
147

POWERED LIFTING APPARATUS USING MULTIPLE BOOMS

CROSS-REFERENCE TO RELATED APPLICATIONS

This is a continuation-in-part of U.S. Ser. No. 09/808,764, filed Mar. 15, 2001, now U.S. Pat. No. 6,601,717 which is a continuation-in-part of U.S. Ser. No. 09/460,479, filed Dec. 14, 1999, now U.S. Pat. No. 6,213,319 which is a continuation of U.S. patent application Ser. No. 08/987,416 filed Dec. 9, 1997 (now U.S. Pat. No. 6,000,562), which is a continuation-in-part of U.S. patent application Ser. No. 08/780,846, filed Dec. 9, 1996, now U.S. Pat. No. 5,836,436 all of which are incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to heavy equipment, and more particularly to heavy lifting equipment that is used in commercial applications for lifting very heavy multi-ton objects that can weigh as much as several thousand tons. Even more particularly, the present invention relates to an improved heavy lifting apparatus that includes a pair of spaced apart trusses, each formed of a pair of booms, each pair being pinned at an upper boom end portion and load transfer carriages provided at the lower ends of the pair of booms, the carriages being connected with a tensile element (e.g., winch cable) that can be wound upon sheaves to increase the mechanical advantage. One of the carriages has a winch that pulls the cable and the two carriages together increasing the angle of inclination of each boom during a lift, a horizontal lifting beam being suspended below the booms for rigging the package to the horizontal beam.

2. General Background of the Invention

In the construction industry and at industrial plants, there is great expense associated with the lifting of very large objects such as chemical process vessels, large pieces of equipment, pre-fabricated buildings and the like. Such objects are typically lifted with one or more very large and expensive devices such as high capacity lifting booms or cranes.

These cranes must be brought into the facility and assembled on site before use when very large lifts are contemplated. This is a very time consuming and expensive operation costing millions of dollars, even for one lift in some cases where the load is very large (e.g., several thousand tons). Scheduling of large equipment can be critical, due to the limited number of very large capacity cranes world-wide and the time restraints and deadlines associated with plant expansions, turnarounds and renovations.

Some of the problems with the lifting of very large objects is the mobilization cost, the complex rigging that must be accomplished timely, and demobilization once the lift is completed.

Huge counterweights are required to equally distribute load, especially if soil conditions are less than perfect. With a crane, ground pressures can be 1000–5000 pounds per square foot. A foundation failure is one of the greatest concerns in any land heavy lift in the Gulf Coast area of the United States. With the present invention, soil bearing pressures are distributed to four carriages. Each carriage then further distributes the load in a balanced manner so that soil bearing pressure might be 100–500 pounds per square foot.

When moving the load (once lifted) over the ground, the present invention is far more stable than a crane that is walking a load. Another problem with crane lifts is that of a rotation or shifting of the object being lifted so that it hits the crane. During a lift, a crane boom is under such stress, that catastrophic failure can result when the object being lifted even lightly hits the crane.

The present invention can be positioned inside buildings without structural modifications that are required when an overhead crane is installed. The only constraint with the present invention is that the apparatus fit inside the building once assembled.

Cranes can also fail if the object being lifted moves (e.g., with wind load) out away from the center of the hook.

BRIEF SUMMARY OF THE INVENTION

The present invention provides an improved method and apparatus for lifting multi-ton packages such as chemical vessels, pre-fabricated structures, equipment packages and the like. This invention requires no counterweights, which can be costly to transport and assemble, because it operates using leverage against itself. Power requirements are reduced using this invention, as the power supply is the horizontal extendable member which carries only the horizontal component of boom load. Ground pressure, a significant problem associated with heavy loads, can be reduced by an order of magnitude by dividing the weight onto four evenly loaded carriages instead of eccentrically loading one crane matrix.

The method of the present invention first provides for the supporting of a first pair of booms from a first pair of carriages or vehicles, wherein the lower end portion of a first boom is pinned to a first carriage, and the lower end portion of the second boom is pinned to the second carriage.

A second pair of booms is supported from a second pair of carriages, wherein the lower end portion of a third boom is pinned to a third carriage and the lower end portion of a fourth boom is pinned to a fourth carriage. Each pair of booms and its carriages defines a generally triangularly shaped variable dimension truss.

The method contemplates pinning the upper end portion of the first and second booms together. The method also contemplates pinning the upper end portion of the third and fourth booms together. These pairs of booms support rigging for lifting the desired multi-ton package, vessel, structure, etc. The booms can be elevated to an erect position by pulling the carriages (on a given track) together. Alternatively, the booms can be erected to their working height and working positions by lifting each respective pair of booms with two (2) land cranes. Then, horizontal slings or cables can connect the pair of carriages on a given railway or like base together from carriage to carriage. This will be feasible in many cases because numerous large construction yards have an inventory of cranes with long booms (for example, 150 feet–250 feet) and lift capacities of about 50–100 tons or more. Such land cranes can erect the four booms in lieu of the horizontal cable and winch that can also be used to pull the carriages on a given track together.

The rigging can include a lifting beam that is generally horizontally positioned and suspended from the upper end portions of the respective pairs of booms, and preferably from the pinned connections of the two variable dimension trusses.

A package is lifted with rigging (eg. traveling blocks, slings, fast line) that depends from the lifting beam when a tensile member (eg. cable) is tightened between the first and second carriages. Likewise, the lifting contemplates a tightening of a second cable that links the third and fourth carriages.

The apparatus of the present invention includes a plurality of carriages that define a structural base for supporting the load to be lifted.

Each truss supported by the plurality of carriages defines a load transfer between the carriages and the multi-ton packages to be lifted.

The trusses include the multiple booms extending respectively from the plurality of carriages and cables that extend in between the pairs of carriages during use.

A first pair of carriages supports a first pair of booms with upper end portions that are pinned together. A second pair of carriages supports the second pair of booms with upper end portions that are pinned together at pinned connections. A lifting beam is supported below the pinned connections.

A first extensible, powered lifting cable connects the first pair of carriages for pulling the carriages together so that the first pair of lifting booms increase in inclination during lifting, thus raising the apex of the first pair of booms and lifting the beam and the object to be lifted.

A second extensible, powered lifting cable connects the second pair of carriages for pulling the carriages together so that the second pair of lifting booms increase in inclination during lifting, thus raising the apex of the second pair of booms and lifting the beam and the object to be lifted.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 2A:
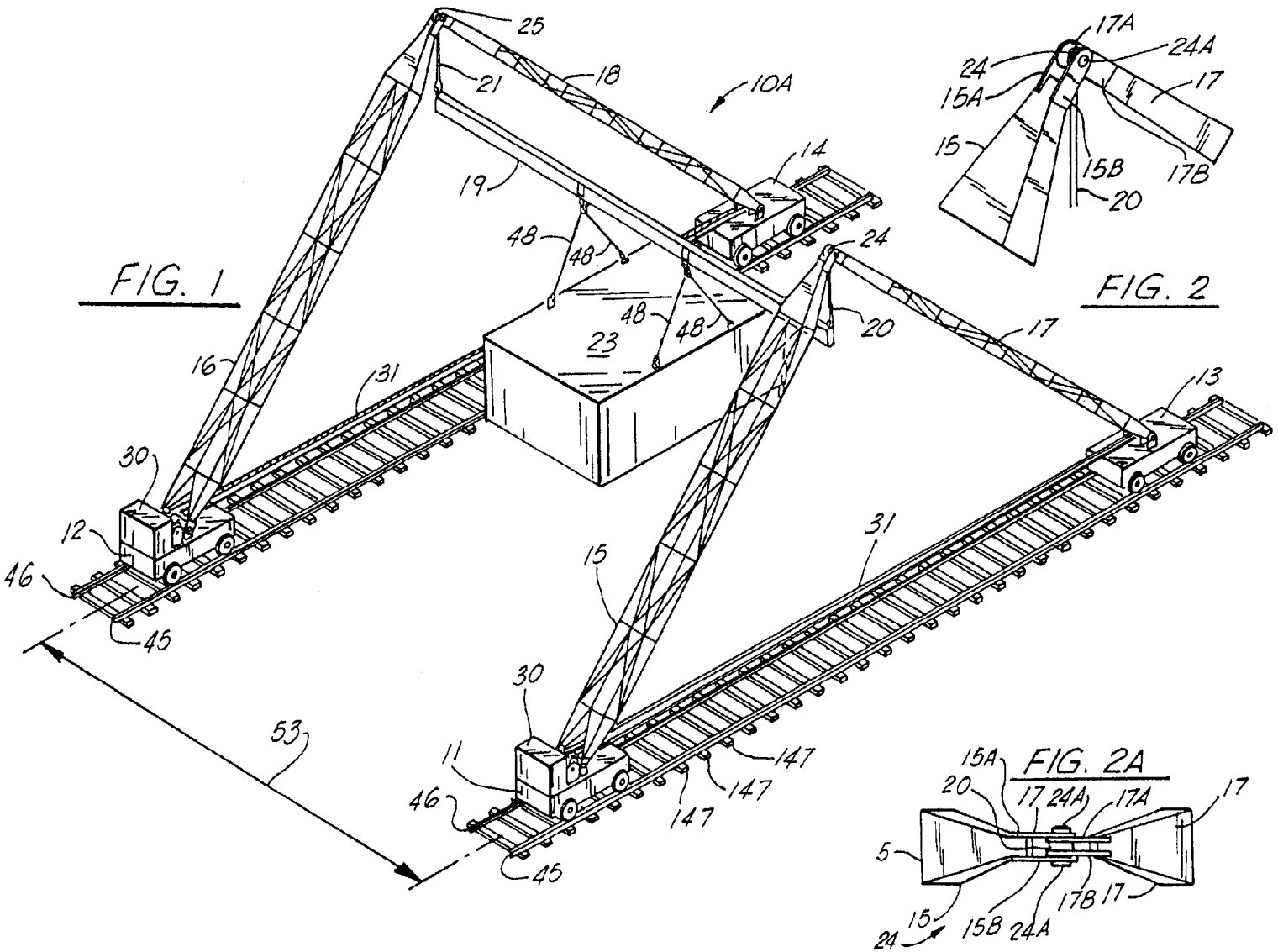
FIG. 1 is a perspective view of the preferred embodiment of the apparatus of the present invention.
FIG. 2 is a fragmentary view of the preferred embodiment of the apparatus of the present invention illustrating the pin connection at the top of a pair of booms.
FIG. 2A is a fragmentary view of the preferred embodiment of the apparatus of the present invention.
Figure 3:
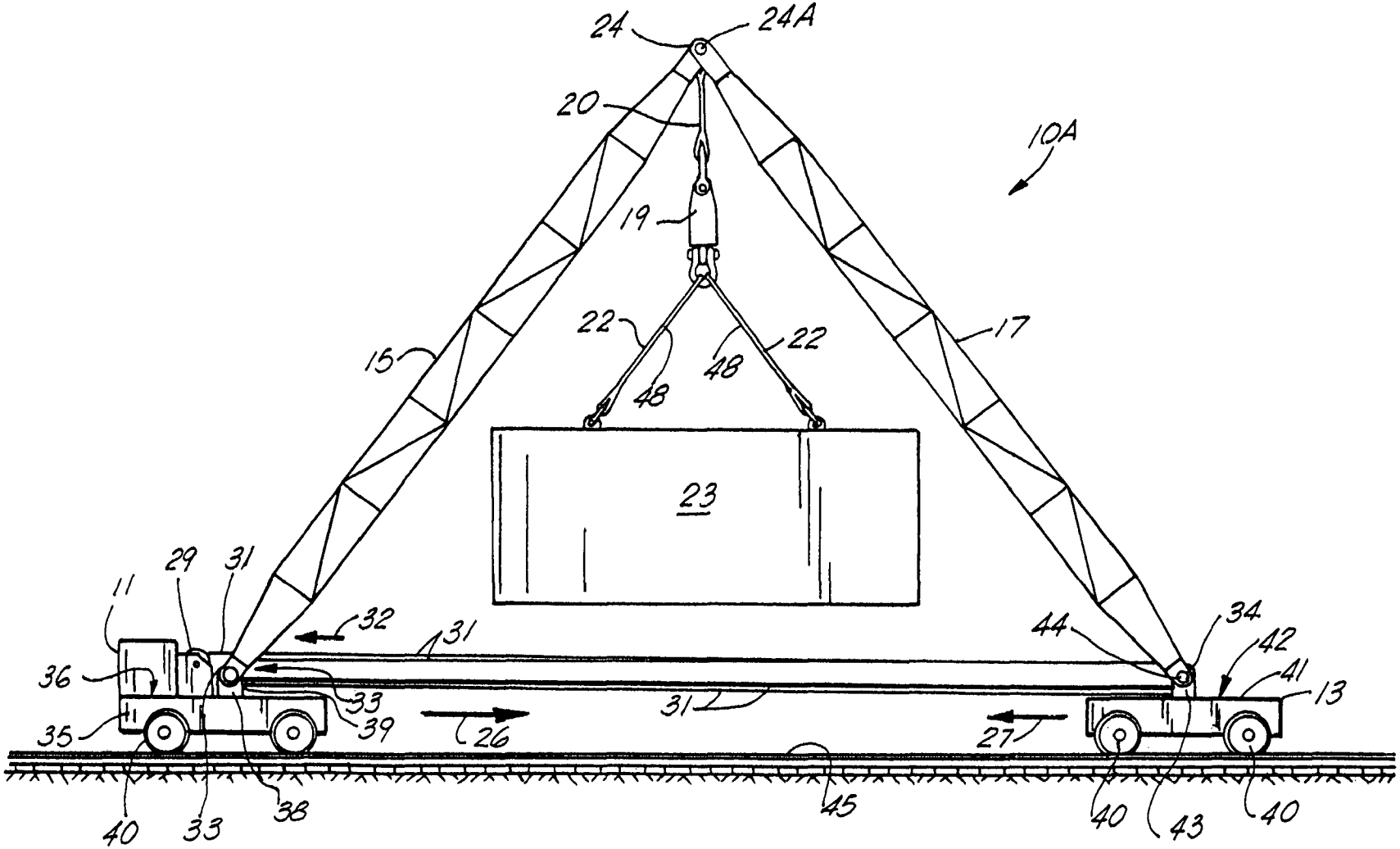
FIG. 3 is an elevational view of the preferred embodiment of the apparatus of the present invention.

FIGS. 1–3 show generally the preferred embodiment of the apparatus of the present invention designated by the numeral 10A in FIGS. 1 and 3.

Lifting apparatus 10A includes four carriages 11, 12, 13, 14. At least two of the carriages 11 are powered, having winches 29 thereon for pulling a cable 31 that is wound upon sheaves 33, 34. The carriages 11, 12 are powered carriages that have winches 29 thereon, each of the winches 29 being powered with a motor drive.

The carriages, 13, 14 are not powered but each has a sheave 34 thereon. Each sheave is wound with the cable 31 as shown in FIGS. 1 and 2. During use, the winch 29 and sheaves 34 are wound so that the two carriages 11, 13 move together when the winch 29 takes up cable. Similarly, the two carriages 12, 11 move together when cable 31 is wound upon winch 29 of carriage 11 or 12.

Four booms 15, 16, 17, 18 are provided with the apparatus 10 of the present invention. The booms are arranged in pairs as shown in FIG. 1. Booms 15 and 17 are attached at their upper end portions together at pinned connection 24. The booms 16, 18 are pinned together at pinned connection 25.

A detail of pinned connections 24 or 25 can be seen in FIGS. 2 and 2A wherein pinned connection 24 is shown. The connection 25 is the same as that shown in FIG. 2 for connection 24. The boom 15 has end portions 15A, 15B that attach to transverse load pin 24A. The boom 17 has end portions 17A, 17B that attach to the pin 24A. Link or sling 20 extends downwardly from pin 24A as shown in FIG. 2. Sling 20 can be a wire rope sling (or slings) with a loop or eyelet end portion that fits pin 24A.

A horizontally extended beam 19 is supported by the spaced apart sling members 20, 21. Each sling 20, 21 is pinned to a transverse pin 24A or 25A of the pinned connections 24, 25 as shown in FIGS. 1–3. Sling 20 hangs from pin 24A of pinned connection 24. Sling 21 hangs from pin 25A of pinned connection 25. Each sling 20, 21 attaches at its lower end to beam 19 using shackles for example. Slings 20, 21 could be rigid links.

The transverse beam 19 is preferably of a length equal to the spacing in between the first pair of booms 15, 17 and the second pair of booms 16, 18. The length of beam 19 is also equal to the spacing between the pairs of tracks 46, 47 shown in FIG. 1, that spacing being designated by the numeral 53 in FIG. 1. A package 23 is shown being supported below beam 19 with sling 22 and rigging 48. Additional spreader bars or beams could be used to lift vessels, coal boxes, generators, or any other object that could be lifted with a crane or jacking system.

During use, the winch 29 of carriages 11 and 12 is powered with a motor (e.g., hydraulic) drive 30 so that the winch 29 can be wound to pull cable 31 in the direction of arrow 32. This causes the carriages 11 and 13 to move together in the direction of arrows 26 and 27 and upon rails 45, 46. As the carriages 11, 13 move closer together, the inclination of booms 15, 17 increases thus elevating the apex 24, 25 of the pair of booms 15, 17 and 16, 18 and package 23 in the direction of arrows 28.

Sheaves 33 and 34 can be used to increase the mechanical advantage afforded during lifting by multiplying the number of windings that cable 31 makes in between the sheaves 33, 34. Cable 31 is wound upon winch 29, then wound a desired multiple times upon sheaves 33 and 34, then anchored at 39 to carriage 11. Because the beam 19 is horizontally extending, a plurality of slings such as 22 can be depended from the beam 19 and at spaced apart locations along the beam 19. This helps in the lifting of horizontally extending objects such as horizontal chemical process vessels and the like. This also enables relatively low power winches to be used when lifting very heavy objects. For example, if a 1000 ton object is to be lifted, a crane would require a 1000 ton vertical hoist capacity. Such a crane would require expensive rigging such as a 1000 ton block. A crane of this capacity costs in the range of several million dollars, a $10,000,000 price being an example.

With the present invention, the booms 15, 17 and 16, 18 could be for example, 50 feet long. For a 1000 ton object and a 60 degree boom angle for each boom, boom load would be about 288 tons. This only requires a 30,000 line load for the cable 31 if, for example, about 12 parts of line are wound upon the sheaves 33, 34.

Each carriage 11, 13 has a chassis 35, 41 respectively. The carriage 11 is shown more particularly in FIG. 2 as including a chassis 35 having an upper surface 36. The upper surface 36 carries motor drive 30 for powering the winch 29. The upper surface 36 also has a plurality of padeyes 38 for supporting the lower end portion of a boom 15, forming a pinned connection 37 in between the boom 15 or 16 and its padeyes 38. Carriage 12 and its boom 16 are of the same general construction as carriage 11 and its boom 15. Carriage 14 and its boom 18 are of the same general construction as carriage 13 and its boom 17.

A cable anchor 39 in the form of a reinforced padeye, for example, can be used to anchor the free end of cable 31 after it is wound the desired number of times about sheaves 33 and 34. In the embodiment of FIGS. 1–3, a plurality of rail engaging type wheels 40 is provided for each carriage 11, 12, 13, 14, each wheel 40 being designed to travel on the pairs of spaced apart rails 46, 47 shown in FIG. 1.

The carriages 13 and 14 each provide a chassis 41 having an upper surface 42 that carries one or more padeyes 43. The padeyes 43 enable a pinned connection 44 to be formed between the lower end portion of the booms 17 and 18 respectively with the carriages 13 and 14, as shown in FIGS. 1 and 3.

The rails 45 and 46 can be supported by a plurality of crossties 47, for example. Rigging 48 can be used to rig a particular package 23 to one or more slings 22 and shackles that depend from horizontal beam 19.

Figure 4:
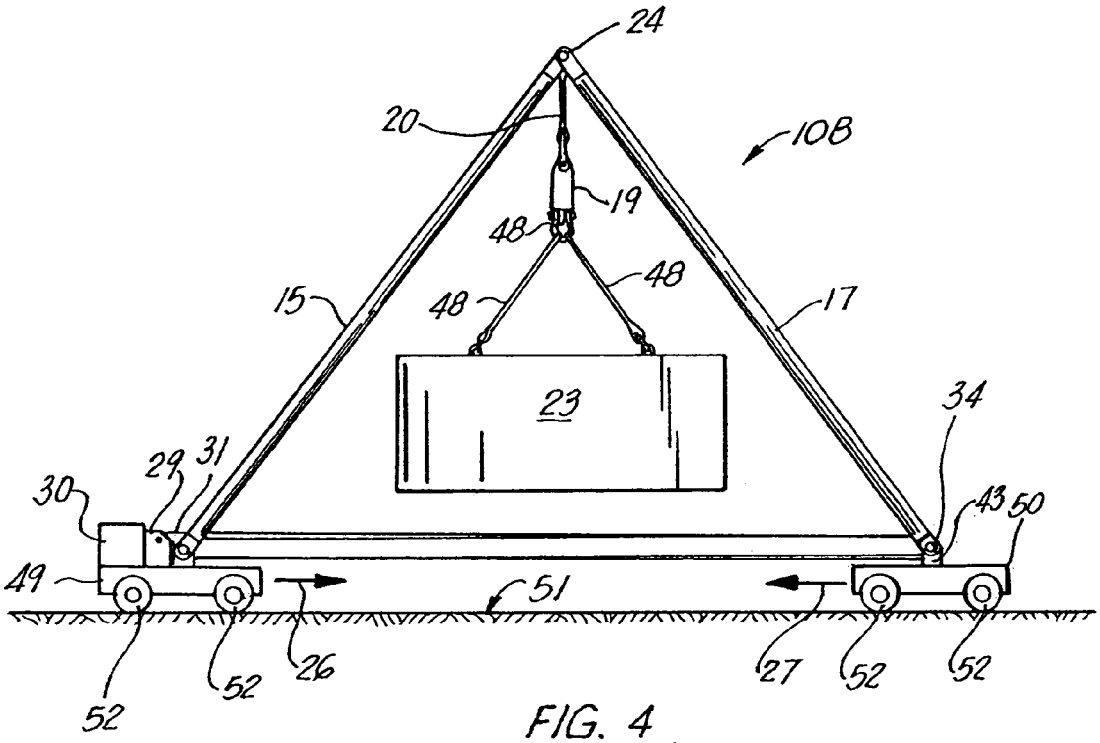
FIG. 4 is an elevational view of a second embodiment of the apparatus of the present invention.
Figure 5:
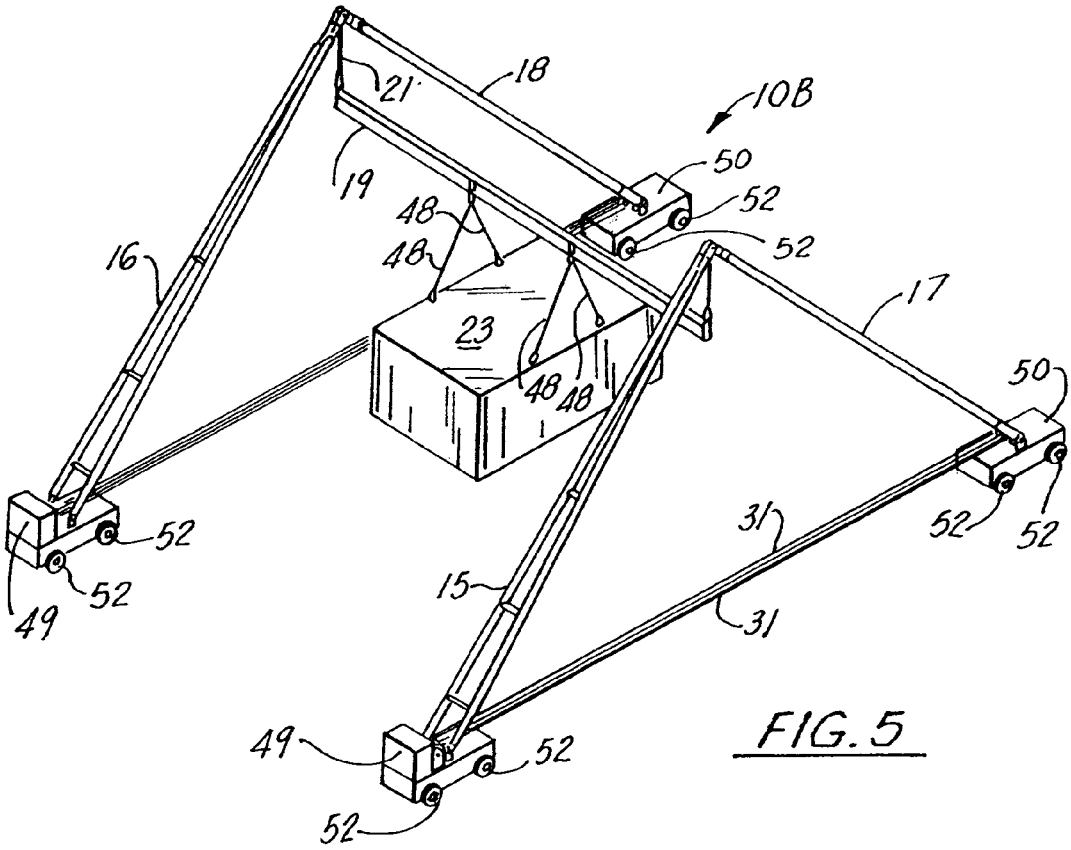
FIG. 5 is a perspective view of the second embodiment of the apparatus of the present invention.
Figure 7:
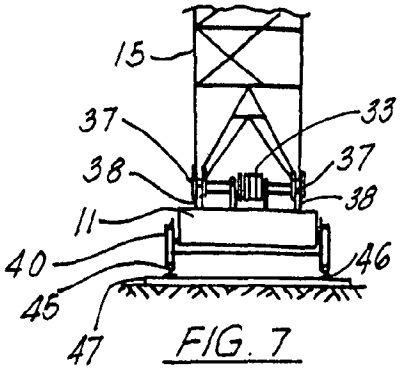
FIG. 7 is a partial elevation view of the preferred embodiment of the apparatus of the present invention.
Figure 8:
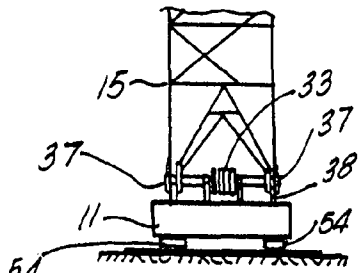
FIG. 8 is a partial elevational view of the second embodiment of the present invention.
Figure 9:
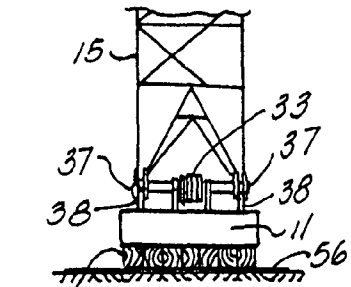
FIG. 9 is a partial elevational view of an alternate embodiment of the carriage showing a skid type carriage.
Figure 6:
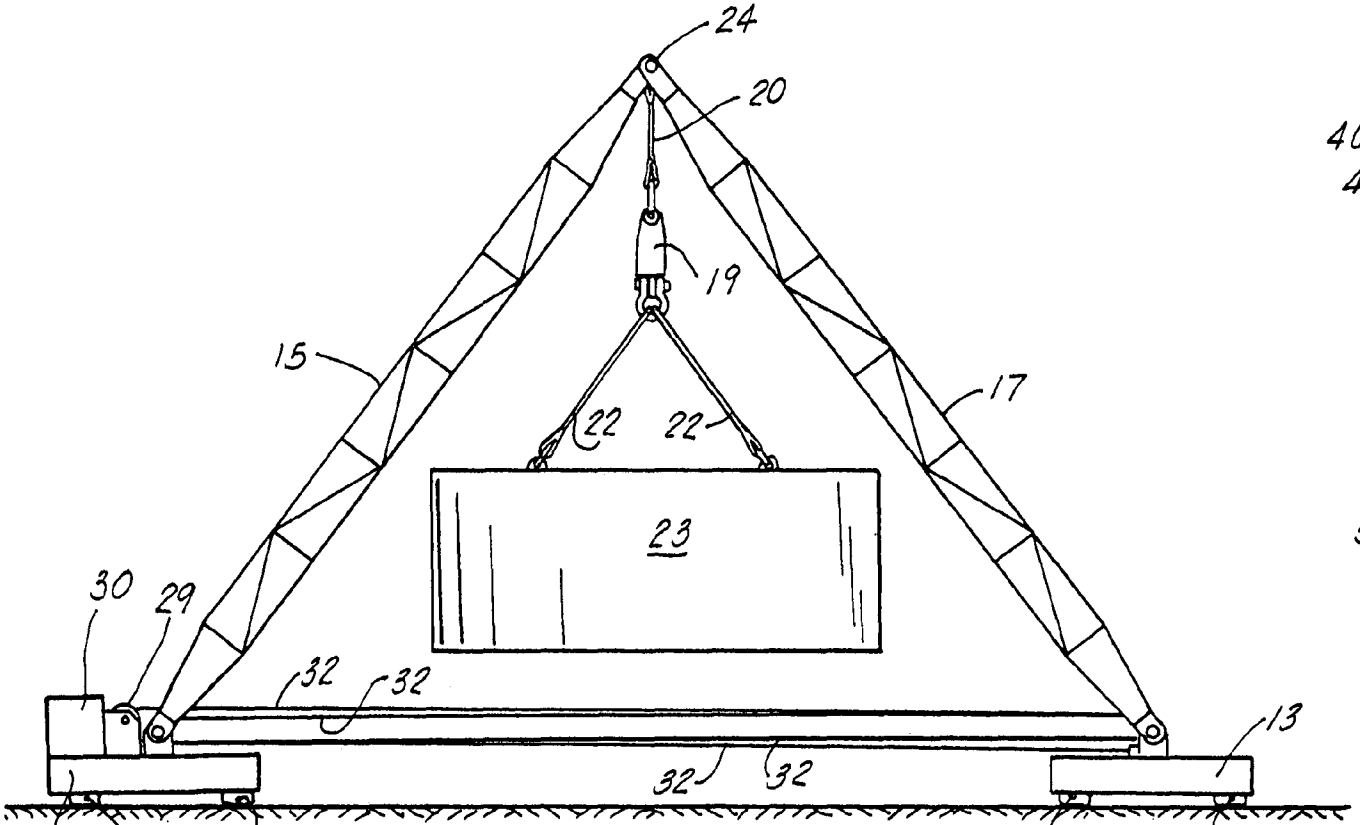
FIG. 6 is an elevational view of a third embodiment of the apparatus of the present invention.

An alternate embodiment of the apparatus of the present invention is shown in FIGS. 4 and 5, designated generally by the numeral 10B. In the embodiment of FIGS. 4 and 5, the wheels 40 are replaced with tires 52 that would engage a flat underlying surface 51 during use. It should be understood however that carriages such as 11, 12, 13, 14 and 49, 50 could also be in the form of skid-mounted or sled-mounted carriages that do not require wheels 40 or tires 52 for operation but rather roll upon small rollers such as Hillman® type rollers 54 as shown in FIGS. 6 and 8 or slide upon a flat underlying surface, as shown in FIG. 9. In FIG. 9, each chassis has an underlying wooden base 55 that slides upon a metal plate 56 (or a plurality of such plates).

FIGS. 10–16 show a third embodiment of the apparatus of the present invention designated generally by the numeral 10C in FIGS. 10, 11, 12, 13, and 14.

Figure 10:
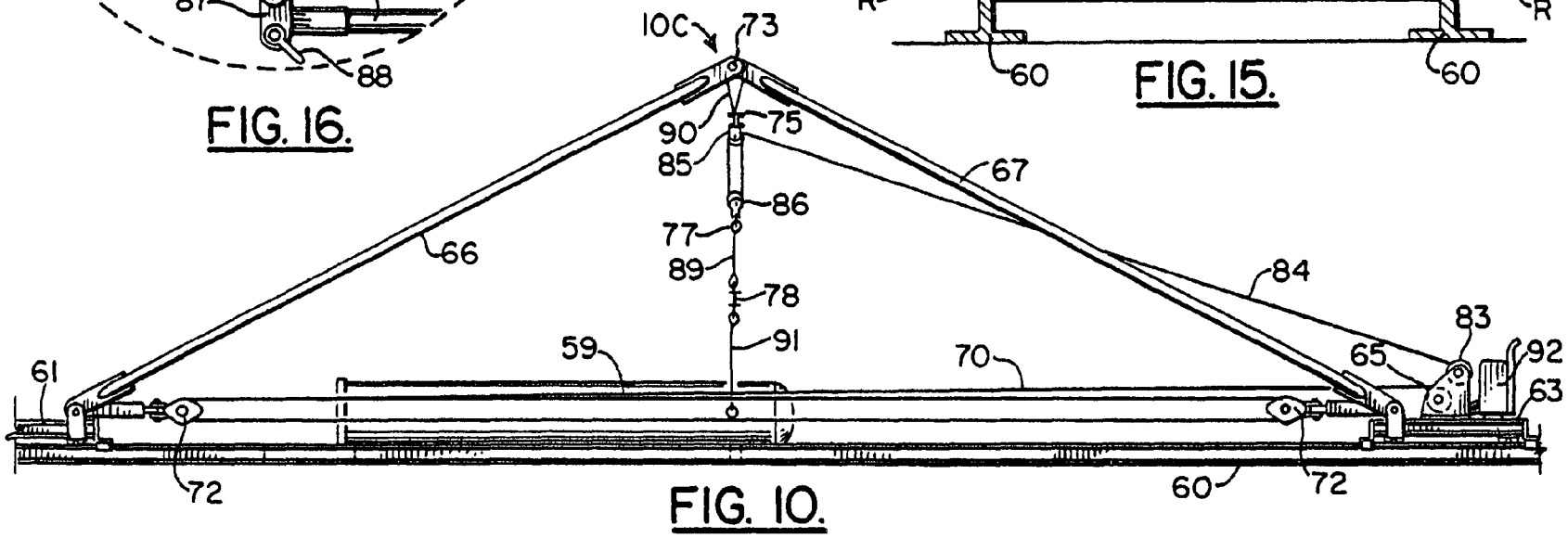
FIG. 10 is an elevational view of a third embodiment of the apparatus of the present invention shown prior to lifting of a horizontally positioned vessel.
Figure 11:
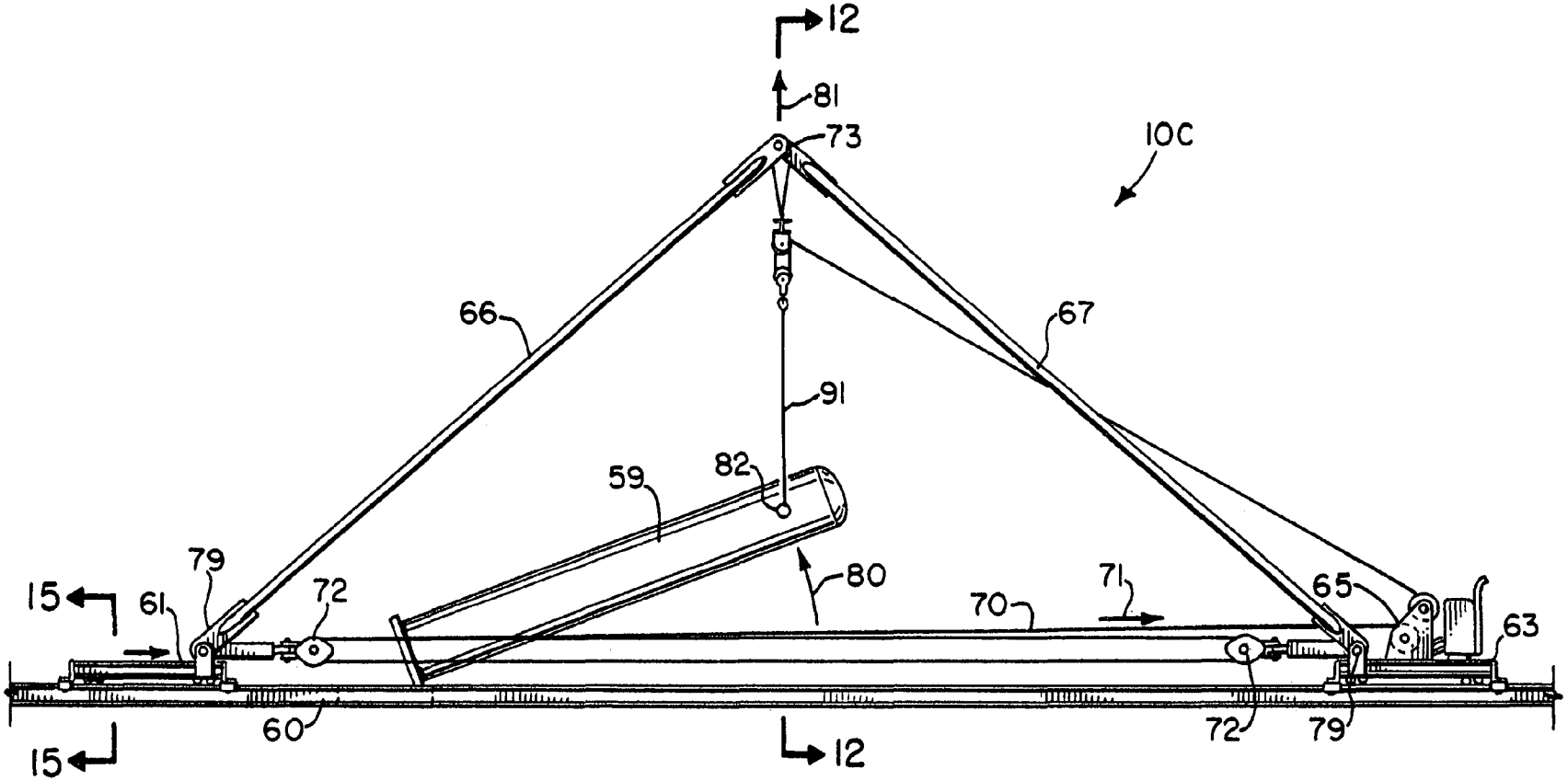
FIG. 11 is another elevational view of the third embodiment of the apparatus of the present invention.
Figure 12:
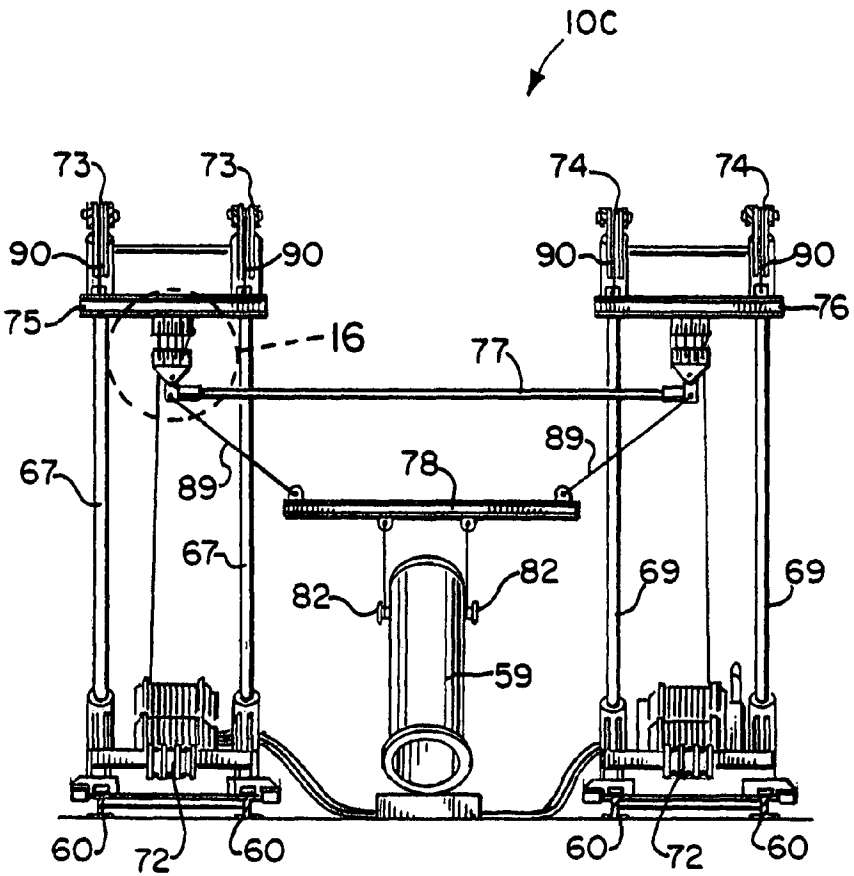
FIG. 12 is an end elevational view of the third embodiment of the apparatus of the present invention shown during lifting of the vessel, taken along lines 12—12 of FIG. 11.
Figure 14:
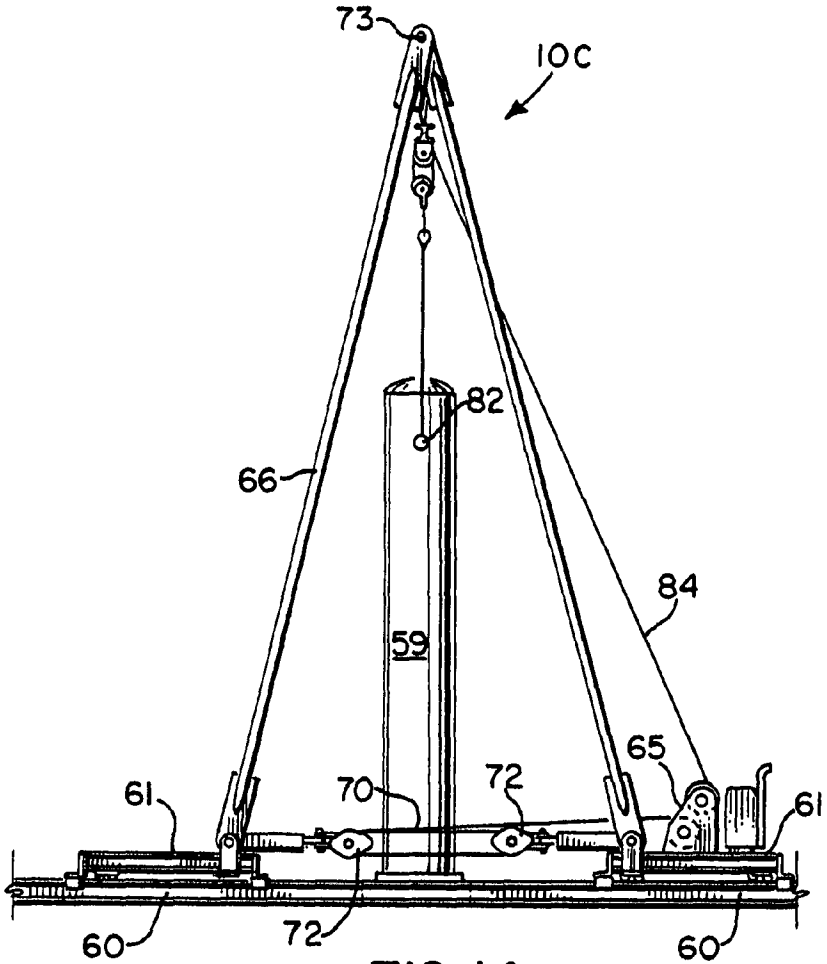
FIG. 14 is an, end elevational view of the third embodiment of the apparatus of the present invention shown after the vessel has been lifted to a vertical position.
Figure 13:
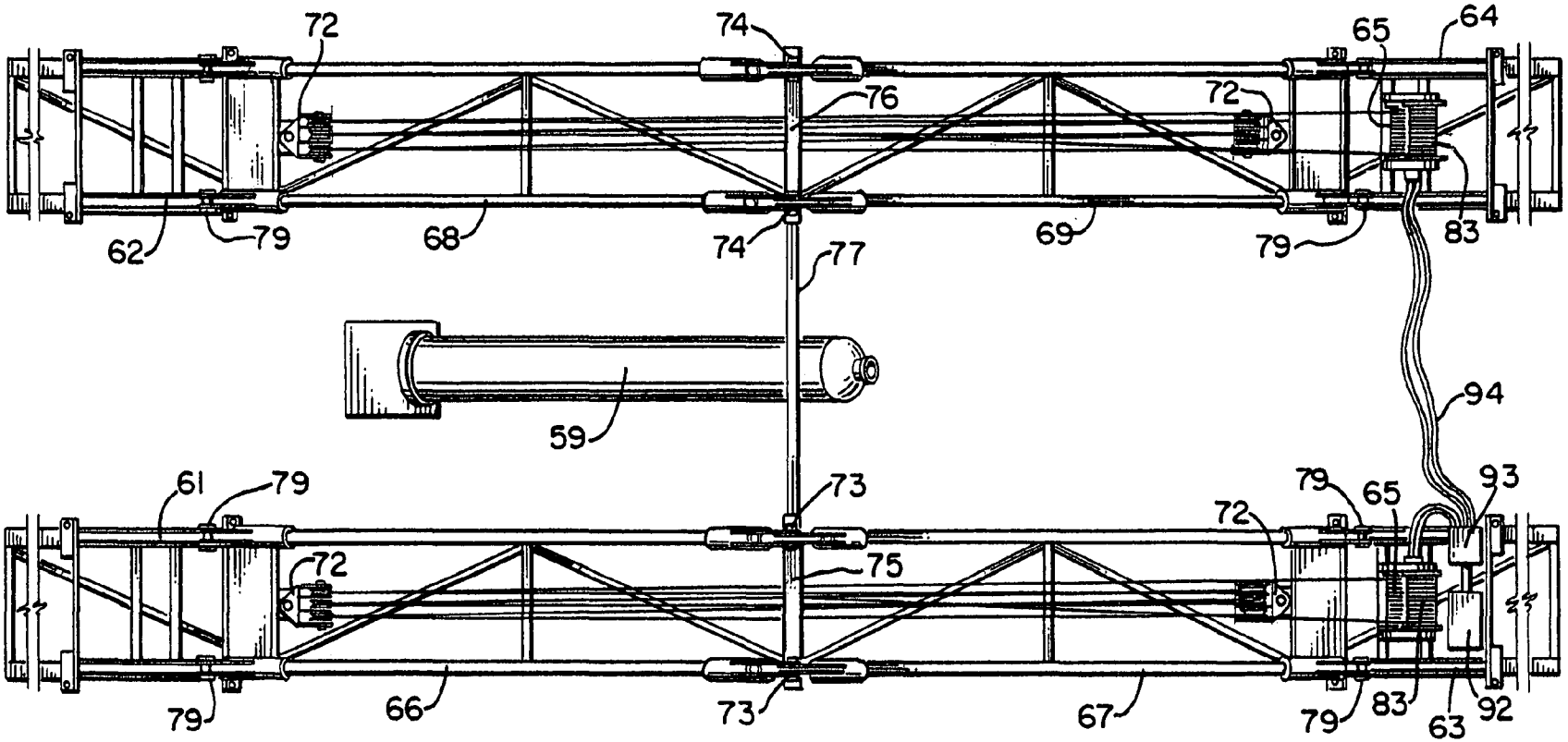
FIG. 13 is a top plan view of the third embodiment of the apparatus of the present invention.

Lifting apparatus 10C is shown lifting a vessel 59 from a generally horizontal position as shown in FIG. 10 to the vertical position shown in FIG. 14. FIGS. 11, 12, and 13 show the vessel 59 in an inclined position as occurs during the lift.

As with the first and second embodiments of FIGS. 1–9, lifting apparatus 10C includes a plurality of carriages that support booms in an opposed and parallel relationship. As with the embodiments of FIGS. 1–9, a pair of booms are pinned and supported respectively by a pair of carriages. A second pair of carriages and respective booms is positioned next to and generally parallel to the first pair of carriages and booms. This arrangement can be seen in FIGS. 10–14 in the drawings.

Figure 15:
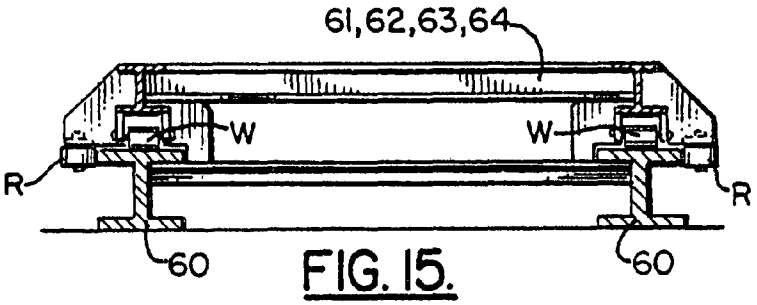
FIG. 15 is a transverse sectional view of the third embodiment of the apparatus of the present invention illustrating the track and carrier undercarriage portions thereof, taken along lines 15—15 of FIG. 11.

A first pair of carriages 61, 62 are mounted upon supports such as rails 60 (see FIG. 15). The carriage 61 supports a boom 66, connected at its base to the carriage 61 with pinned connection 79. Similarly, a second boom 67 is attached to the carriage 63 at pinned connection 79. The booms 66 and 67 have upper end portions that are pinned at connection 73 as shown in FIGS. 10 and 13.

A second pair of carriages 62, 64 are supported by a second set of supports (e.g., rails) 60. Each carriage 61, 62, 63, 64 can have supporting wheels W engage supports 60. Rollers R can be used to engage the sides of rail supports 60 for lateral stability. Each of the carriages 61, 62, 63, 64 has a winch 65 that is wound with cable 70 and upon sheaves 72. This rigging can best be seen in FIGS. 10 and 13. Each carriage 61, 62, 63, 64 provides a sheave 72. The pair of carriages 61 and 63 have a winch 65 that takes up the cable 70 during lifting in order to pull the carriages 61, 63 together. Similarly, the pair of carriages 62, 64 have a winch 65 that takes up the cable 70 during lifting in order to pull the carriages 62, 64 together. The cable 70 can be wrapped several times around the sheaves 72 as shown in FIG. 13 for increasing lifting capacity. In FIG. 11, arrow 71 indicates the direction of travel of cable 70 as it is taken up by winch 65 on each of the carriages 63, 64 during a lift. As the winch 65 on carriages 63 takes up cable 70, as shown in FIG. 11, the apex of the booms 66, 67 as defined by pinned connection 73 elevates in the direction of arrow 81 as shown in FIG. 11. At the same time, winch 25 on carriage 64 takes up cable to elevate the apex of booms 68, 69. The vessel 59 gradually inclines during lift as shown by arrow 80 as the vessel is lifted by a rigging supported by the pinned connections 73, 74, and attached to the upper end of the vessel at attachment 82.

In FIGS. 11–13, the vessel 59 is in the inclined position as occurs during a lift. In FIG. 14, the vessel 59 is in a vertical position after the lift is complete.

Figure 16:
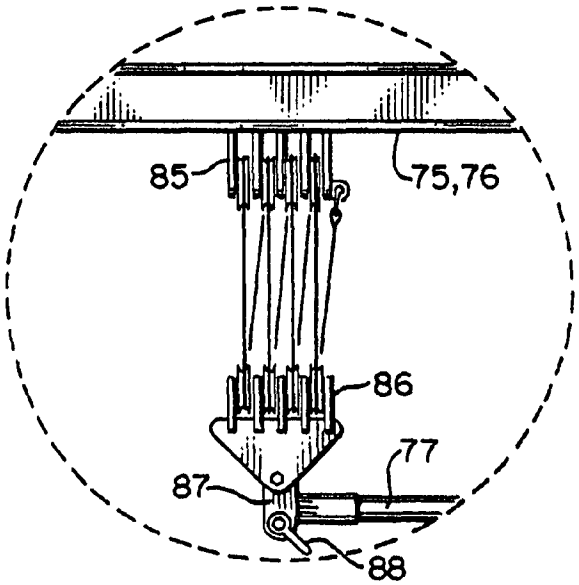
FIG. 16 is a fragmentary view of the preferred embodiment of the apparatus of the present invention illustrating the connection between the horizontal beam portions thereof.

A second winch 83 is provided on each of the carriages 63, 64 for providing a load line 84. The load line 84 can be rigged between crown block 85 and traveling block 86. The crown block 85 and traveling block 86 enable lifting and elevation change for the package in addition to the lifting elevation change achieved by changing inclination of the booms 66, 67, 68, 69. In FIG. 16, a detail of the rigging between beams 75, 76 and the horizontal beams 77 is shown. A crown block 85 can be attached by welding, for example, to each of the horizontal beams 75, 76. A traveling block 86 is attached to each end of horizontal beam 77, being pinned thereto at end caps 87. Such end caps 87 are commercially available, being manufactured by Versabar, Inc. of Belle Chasse, La. A shackle 88 depends from each end cap 87 and supports a diagonally extending sling 89. Each sling 89 (see FIG. 12) supports an end of lower horizontal beam 78.

The two upper horizontal beams 75, 76 are supported below the pinned connections 73, 74 respectively of booms 66, 67 and 68, 69. Slings 90 can be used to form an attachment between pinned connection 73 and the upper horizontal beams 75. Slings 90 can also form an attachment between pinned connection 74 and beam 76. A pair of slings 91 can be extended between lower horizontal beam 78 and vessel 59 as shown in FIGS. 10 and 12.

Winches 65, 83 can be powered with a power source such as diesel engine 92. Hydraulic pumps 93 with associated control valves can be powered by engine 92 for operating winches 65, 83. The winches 65, 83 can thus be hydraulic winches such as those manufactured by Fritz Culver, Inc. Hydraulic hose flow lines 94 can be used to interface each of the winches 65, 83 on the carriages 63, 64 with engine 92.

As an alternate to the use of a winch and cable in order to pull the carriages together during a lift or during erection, another simple erection procedure is to lift each boom pair with two land cranes to their working height and then connect horizontal slings from carriage to carriage. This will be feasible in many cases because numerous large construction yards have an inventory of cranes with long booms (for example, 150 feet–250 feet) and with high lift capacities of 50–100 tons or more. Such land cranes can erect the four booms in lieu of the horizontal cable and winch arrangements shown in the drawings or in lieu of horizontal traveling blocks that span from carriage to carriage.

Figure 17:
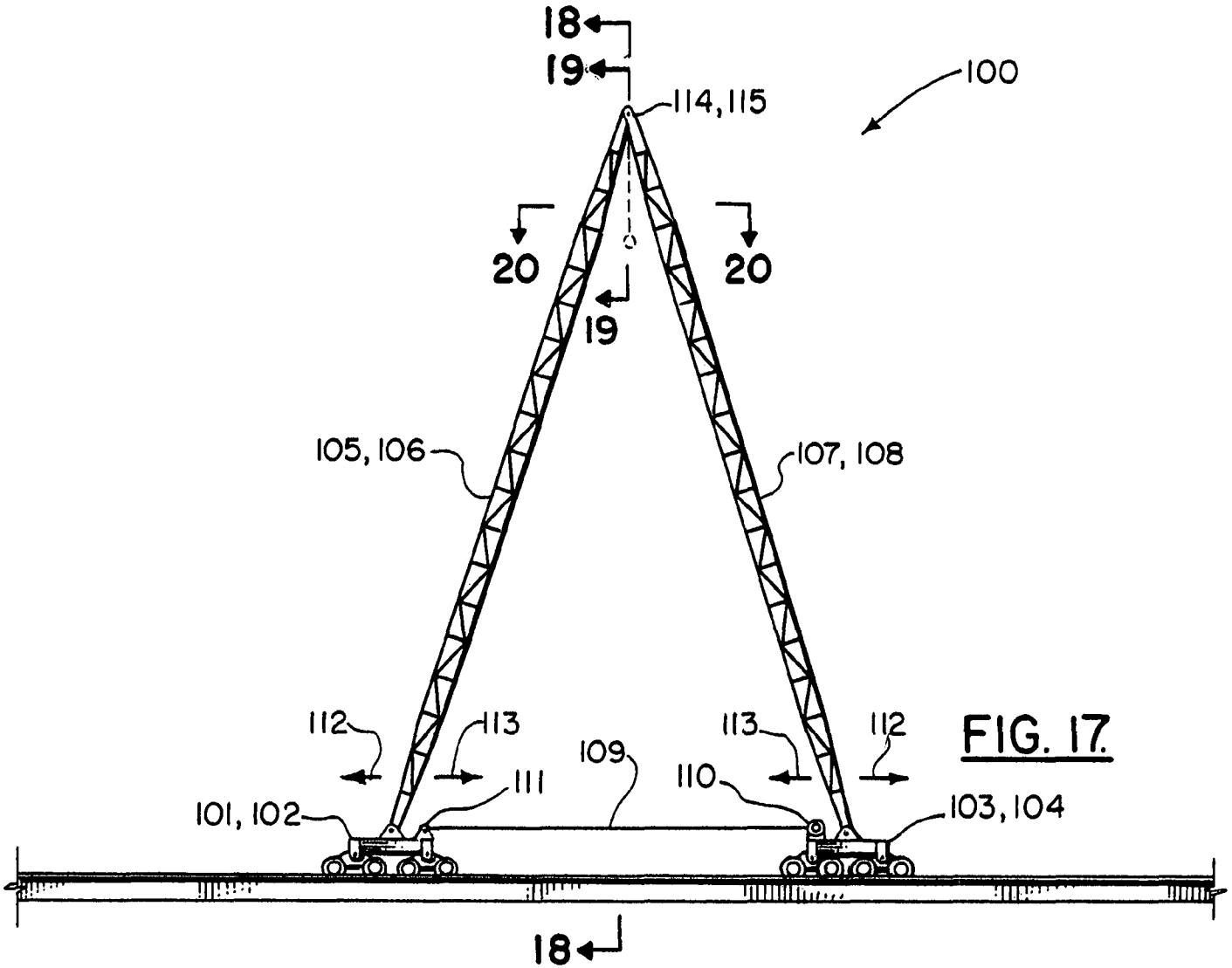
FIG. 17 is a side elevation view of a fourth embodiment of the apparatus of the present invention.
Figure 18:
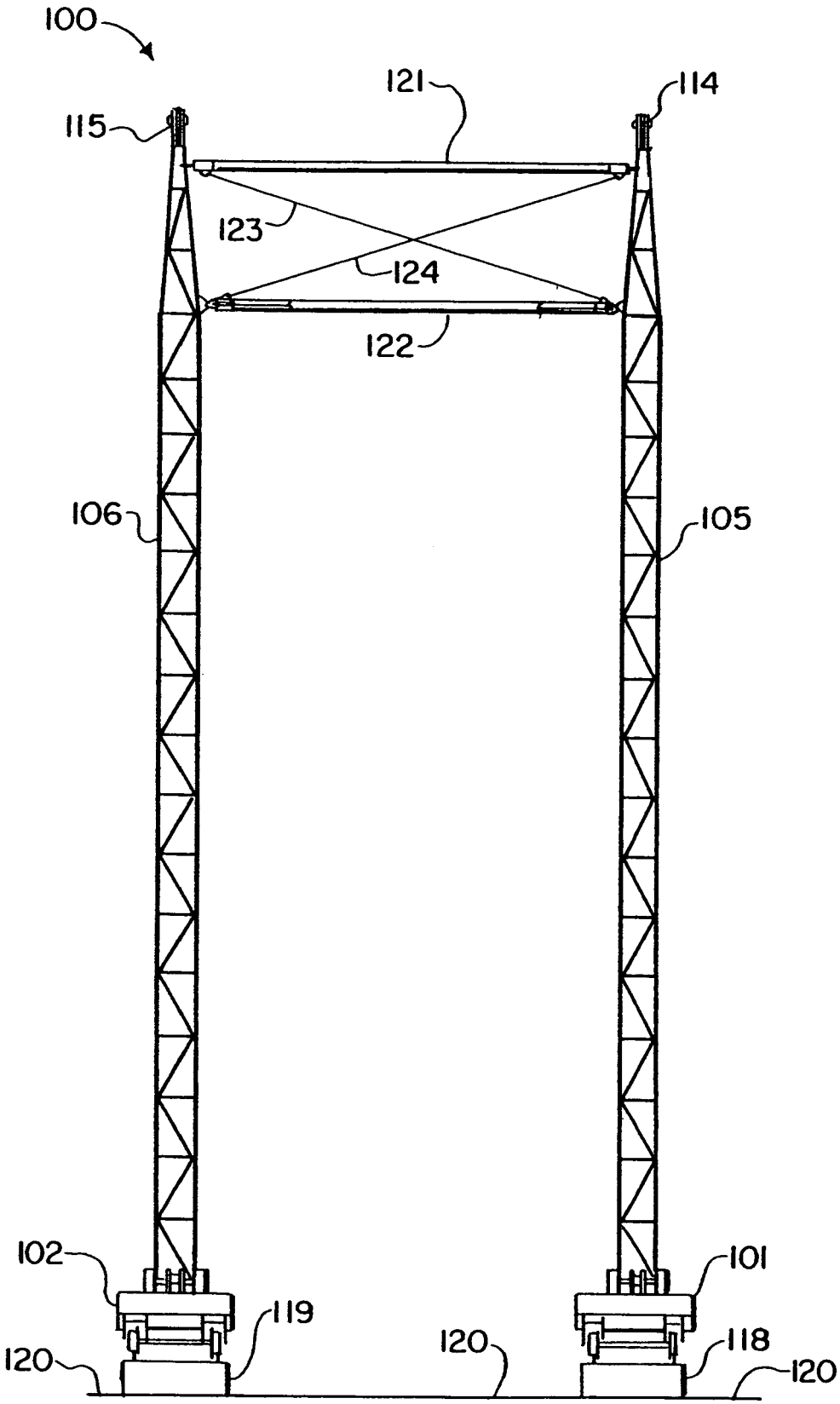
FIG. 18 is a sectional elevational view taken along lines 18—18 of FIG. 17.
Figure 19:
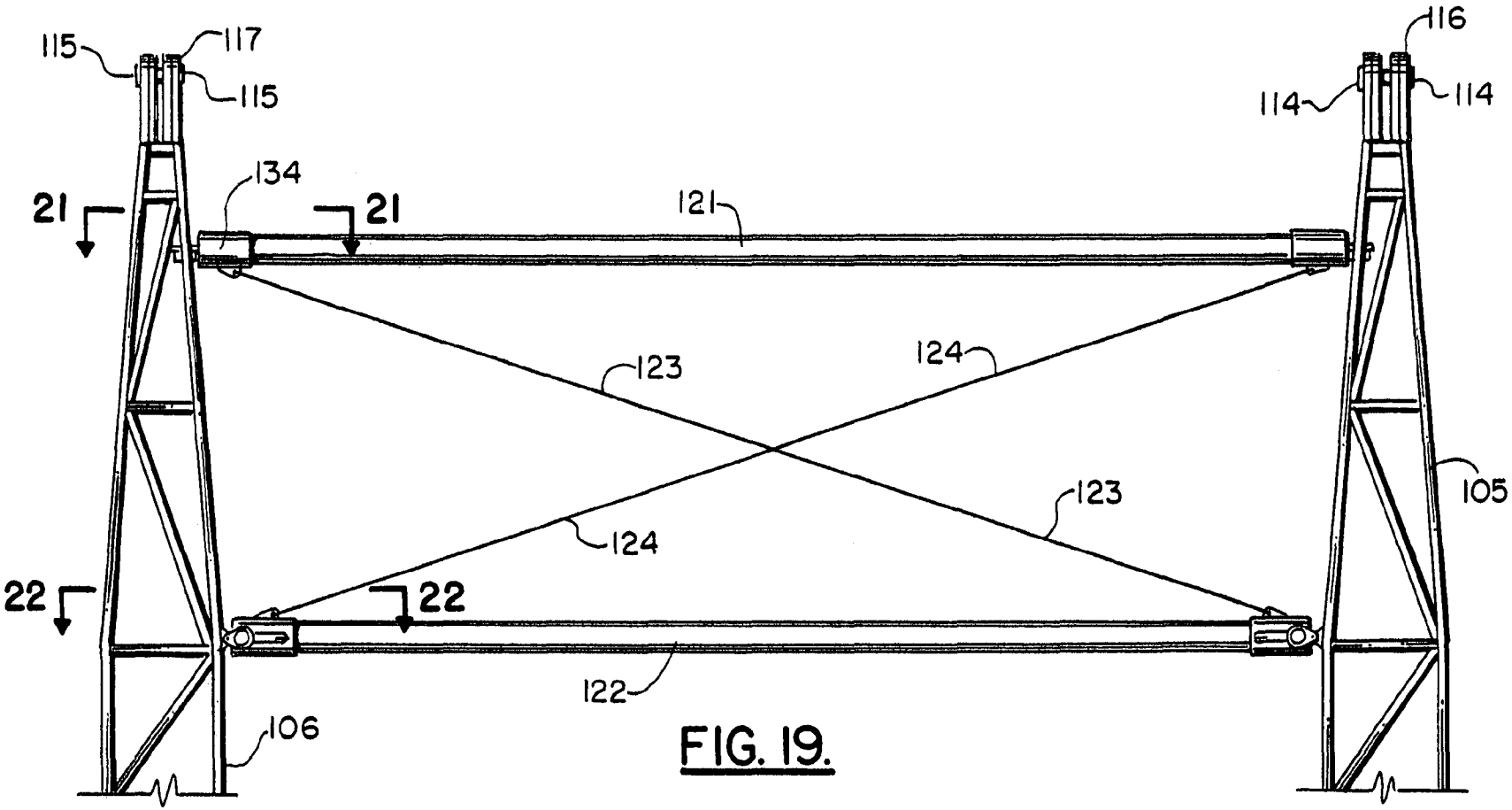
FIG. 19 is a sectional elevational view taken along lines 19—19 of FIG. 17.
Figure 20:
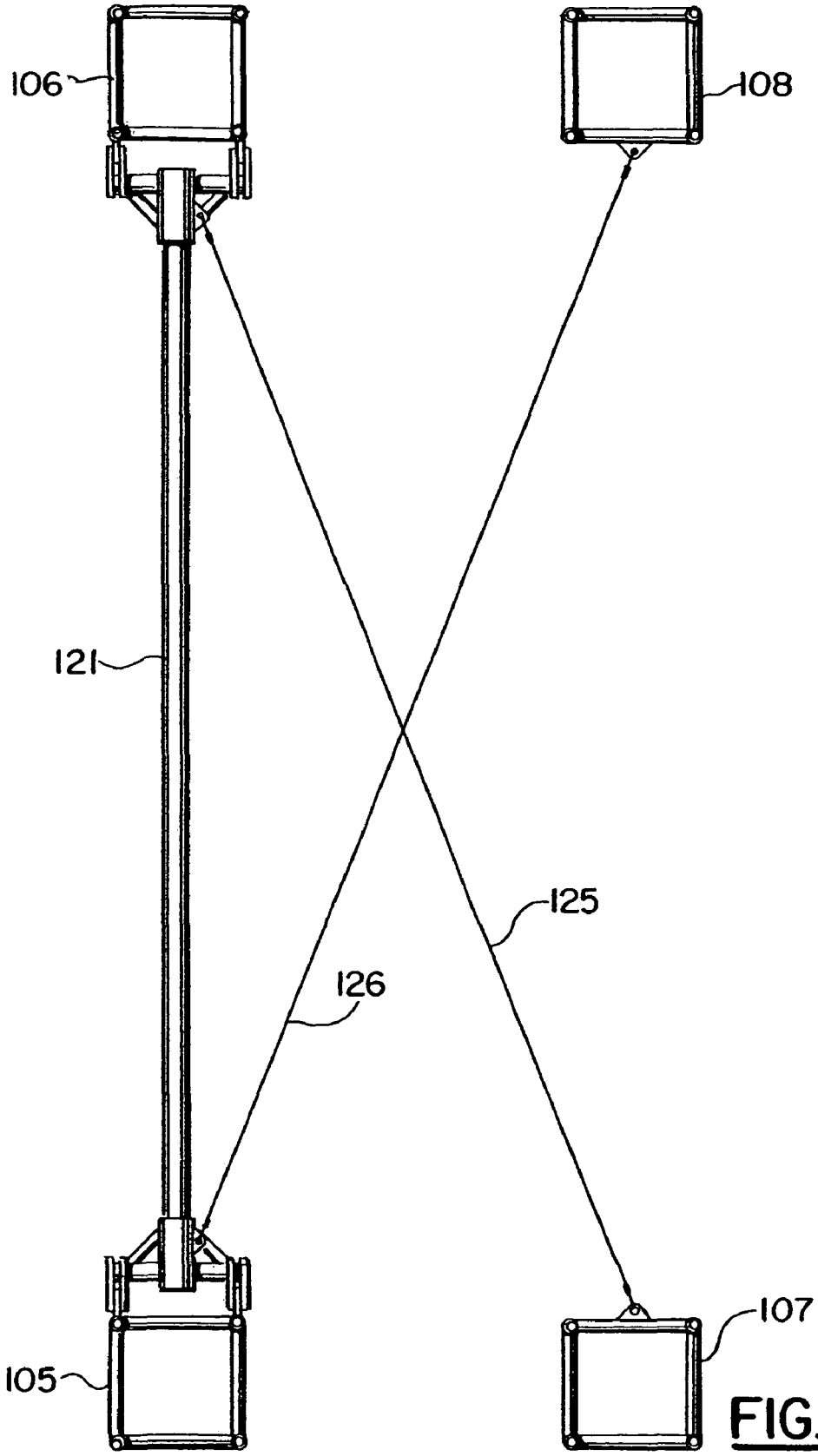
FIG. 20 is a plan partial sectional view taken along lines 20—20 of FIG. 17.

FIGS. 17–26 show the fourth alternative embodiment of the apparatus of the present invention designated generally by the numeral 100 in FIGS. 17 and 18. Lifting apparatus 100 provides four carriages 101, 102, 103, 104. Each carriage 101–104 supports a boom. The lower end of each boom 105–108 can be pinned to its respective carriage 101–104. In FIGS. 17 and 18, carriage 101 supports boom 105, carriage 102 supports boom 106, carriage 103 supports boom 107, and carriage 104 supports boom 108. As with the embodiments of FIGS. 1–16, lifting apparatus 100 pairs the four booms so that booms 105 and 107 are pinned together at pinned connection 114 to define a first pair and a first truss. Similarly, the paired booms 106, 108 are pinned together at pinned connection 115 to define a second pair and second truss. These pinned connections 114, 115 each define a boom apex. The pinned connection 114 is at boom apex 116. The pinned connection 115 is at boom apex 117.

As with the embodiments of FIGS. 1–17, each pair of booms that are pinned together such as 105, 107 and 106, 108 are made to travel together in the direction of arrows of 113 in order to lift an object. The booms can also be spread apart in the direction of arrows 112 in FIG. 17 in order to lower an object. A tensile member is one way to pull the carriages 101–104 together in order to lift an object or to space the carriages 101, 105 apart in order to lower an object. A jacking system could be another way. A vertical traveling block can be used to lift or lower the load as shown in other embodiments.

The tensile member can be in the form of cable 109 that is paid out or reeled in using a powered winch 110. Cable 109 on carriage 103 can be attached at attachment 111 to the carriage 101 that is opposite the carriage 103 having winch 110 thereon. Alternatively, attachment 111 can be a sheave so that the cable 109 can be wound upon the sheave in order to increase the tensile capacity of the connector 109. For example, multiple sheaves can be provided with an endless cable 109 wound thereupon multiple times in order to increase the capacity of the tensile connector or cable 109. As with the embodiments of FIGS. 1–16, each pair of carriages such as 101, 103 associated with a pair of booms such as 105, 107 can be mounted upon a runway 118 or 119. Runways 118, 119 can be rails, concrete, timber or other suitable structural interface between the carriages 101, 104 and the underlying earth 120.

The present invention provides a cross bracing arrangement that is shown in FIGS. 17–26. This cross bracing provides lateral stability for the apparatus 100. Its placement at the top of the booms optimizes the stability requirement. Cross bracing arrangement includes an upper brace 121 and a lower brace 122 that can be generally parallel to upper brace 121. Additionally, the bracing arrangement can include diagonal braces 123, 124. As shown in FIG. 18, the upper brace 121 spans between the upper end portions of booms 105, 106. The lower brace 122 spans between the upper end portions of the booms 105, 106 but at an elevational position below the brace 121 as shown in FIG. 18. Diagonal brace 123 extends from an end portion of brace 121 diagonally to and opposing end portion of brace 122. Similarly, diagonal brace 124 extends from an end portion of upper brace 121 diagonally to an opposing end portion of brace 122.

Figure 22:
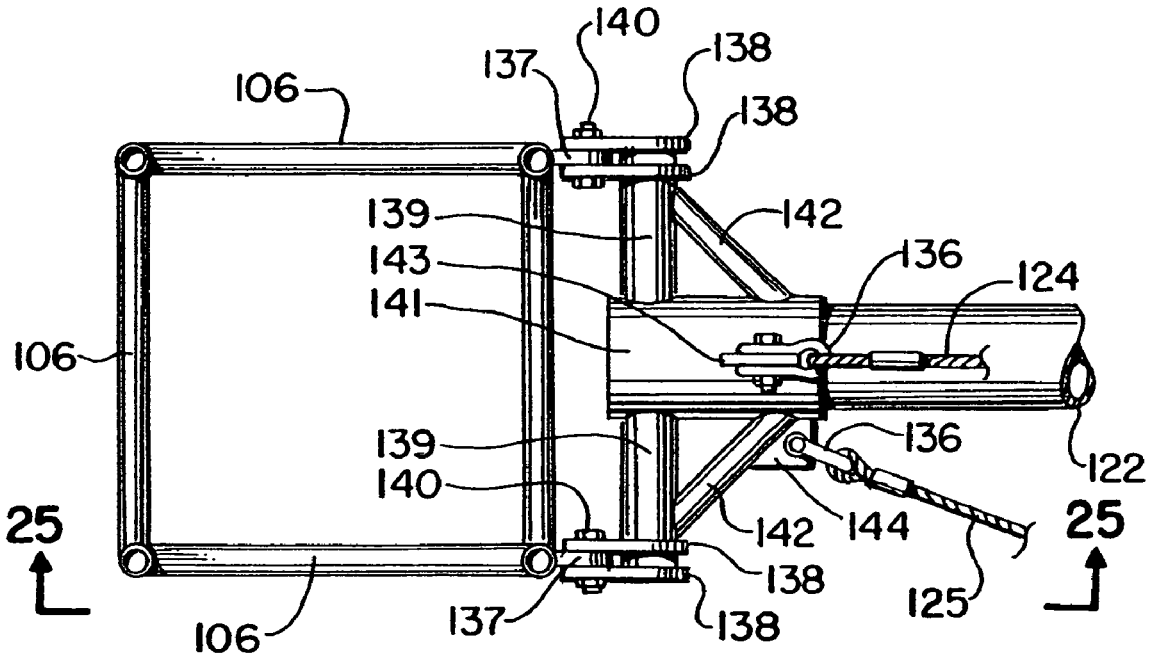
FIG. 22 is a sectional view taken along lines 22—22 of FIG. 19.
Figure 23:
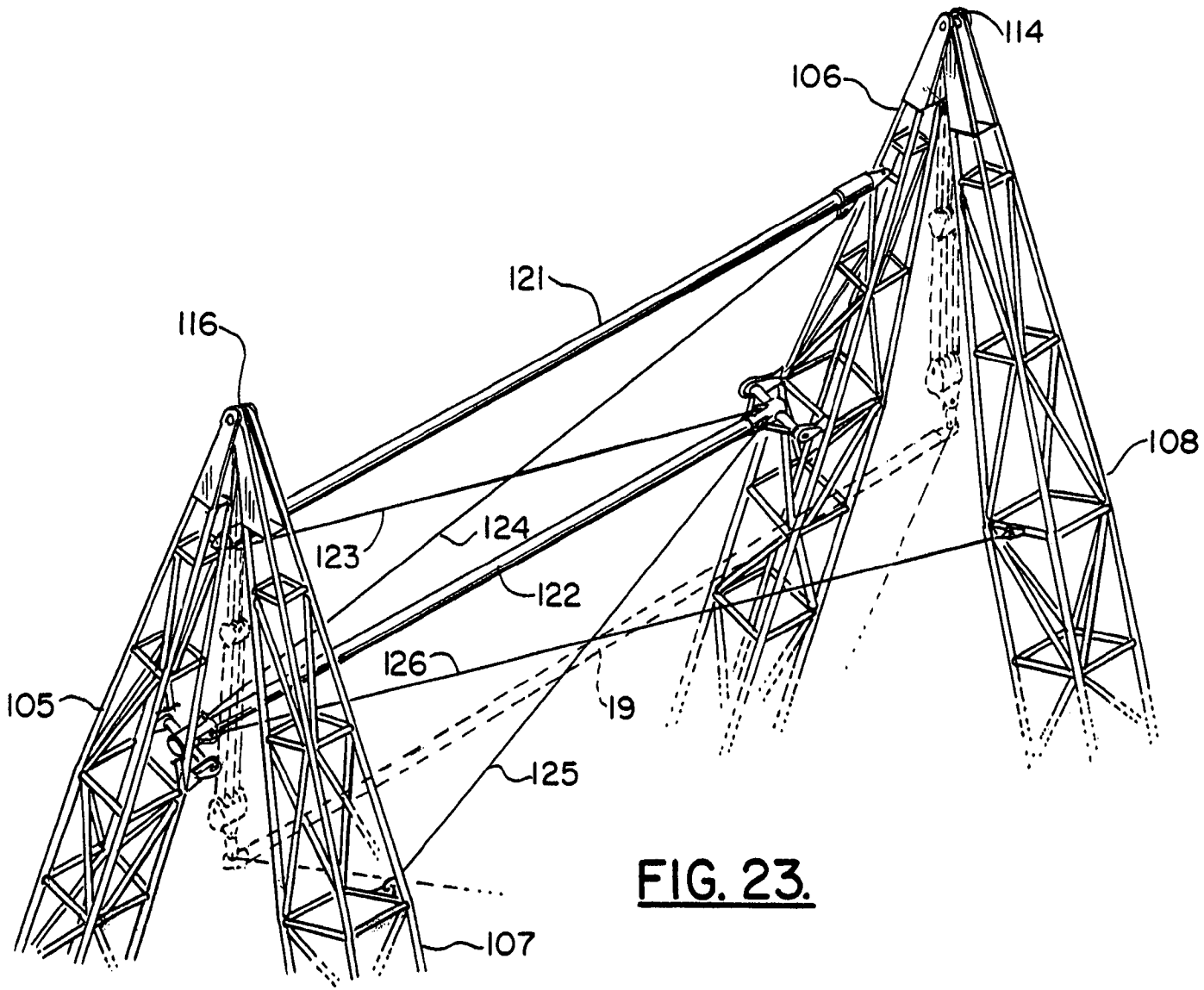
FIG. 23 is a partial perspective view of the fourth embodiment of the apparatus of the present invention.

The details of connection between each of the braces 121, 122, 123, 124 and the booms 105, 106 can be seen in FIGS. 21–26. The braces 121, 122, 123, 124 can occupy a common plane. Additional braces 125, 126 are generally horizontally positioned. The brace 125 as shown in FIG. 23 extends diagonally from boom 107 to boom 106. The brace 126 extends diagonally from boom 105 to boom 108. These generally horizonally positioned braces 125, 126 are preferably located at a position below the brace 122.

Figures 24, 24A:
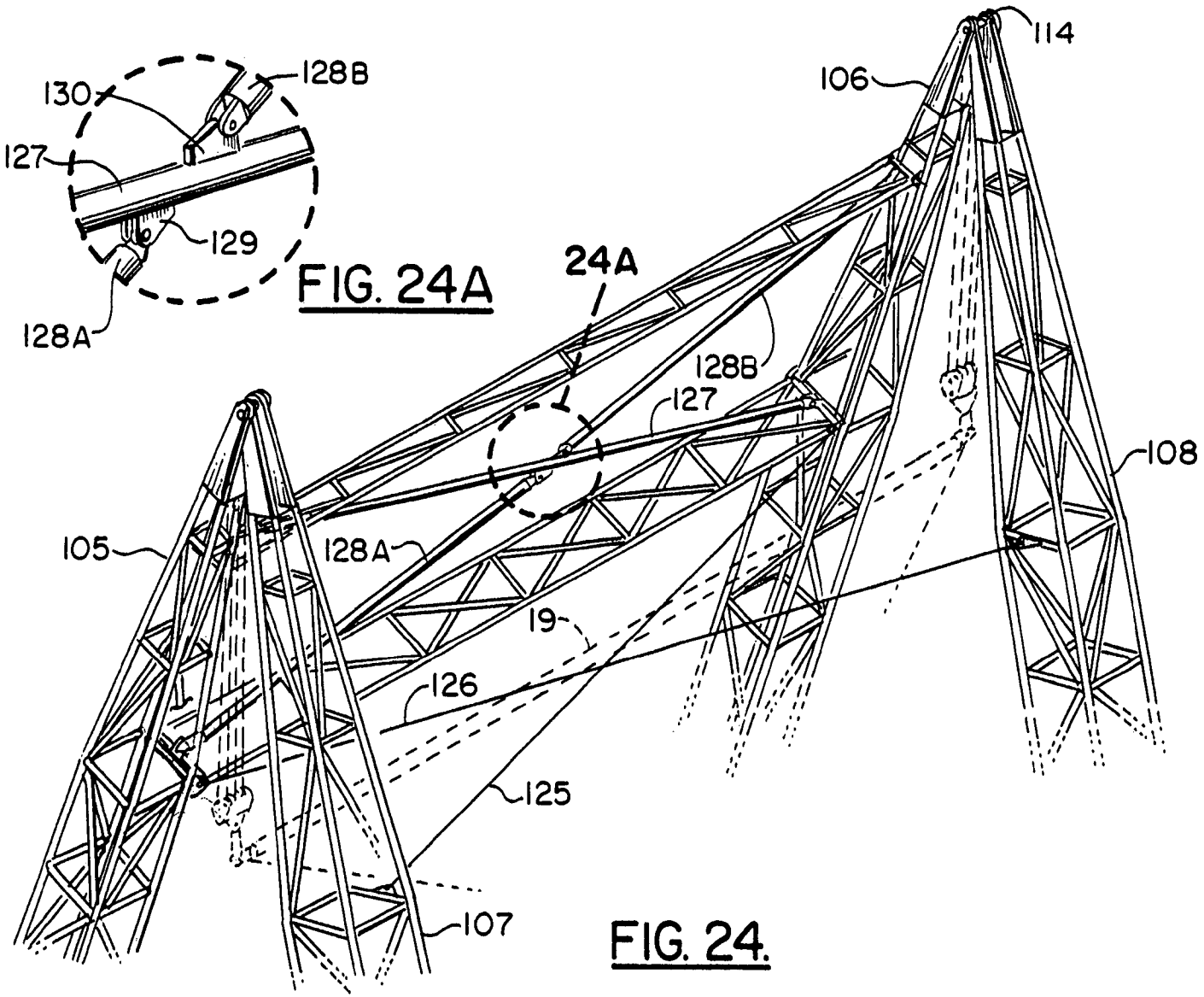
FIG. 24 is a partial perspective view of the fourth embodiment of the apparatus of the present invention and showing an alternate bracing arrangement.
FIG. 24A is a fragmentary view of the fourth embodiment of the apparatus of the present invention.

In FIGS. 24–24A, the diagonal braces 123, 124 have been replaced with diagonal brace 127 and diagonal braces 128A, 128B. The brace 127 provides a pair of opposed padeyes 129, 130 but each form a pinned connection with one of the diagonal braces 128A, 128B. As shown in FIGS. 24 and 24A, the diagonal braces 128A and 128B are shorter diagonal braces that extend to the midsection of the brace 127.

Figure 21:
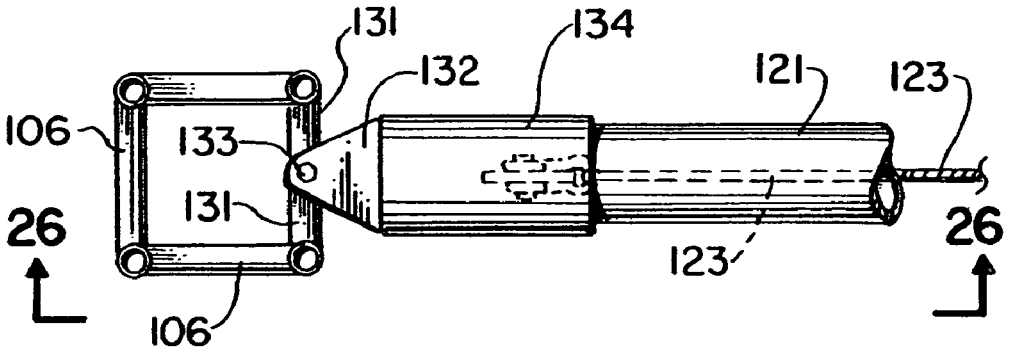
FIG. 21 is a sectional view taken along lines 21—21 of FIG. 19.
Figure 25:
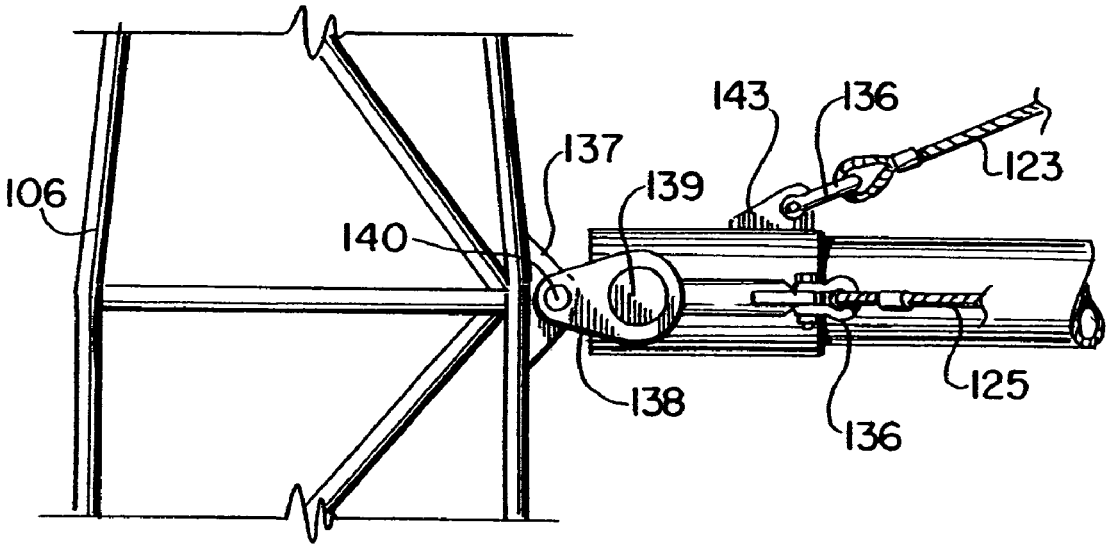
FIG. 25 is a fragmentary view taken along lines 25—25 of FIG. 22.
Figure 26:
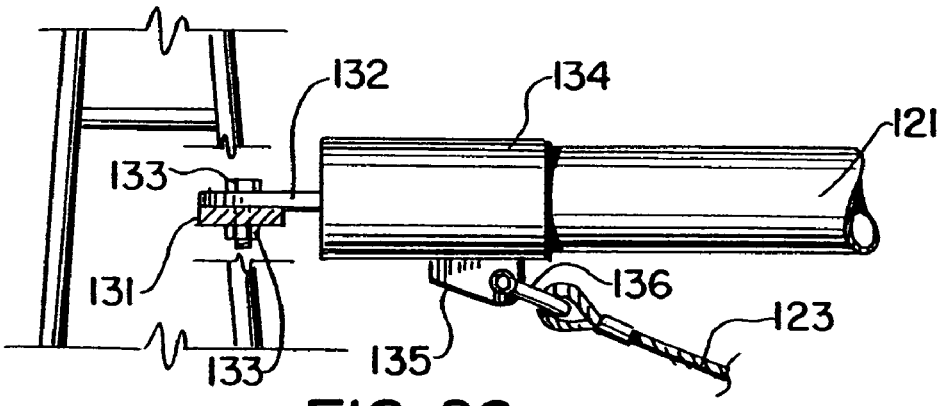
FIG. 26 is a fragmentary view taken along lines 26—26 of FIG. 21.

The braces 123, 124 can be flexible members such as cables or slings. The members 127 and 128A, 128B can be more rigid members such as for example elongated structural tubular members (eg. steel pipe sections). FIGS. 21 and 22, 25–26 show more particularly the connection between the various diagonal braces 123–127 and the booms 105, 106. In FIGS. 21 and 26, an upper connection is shown that is typical of the connection between upper brace 121 and booms 105 or 106. Plate 131 is welded transversely to boom 106 as shown in FIGS. 21 and 26. Plate 132 attaches to plate 131 with a pinned connection 133.

End cap 134 can be a cylindrically shaped, structural end cap having a cylindrical socket that receives upper brace 121 thereinto as shown in FIG. 21. End cap 134 has plate 135 that forms an anchor for attaching diagonal brace 123 thereto at shackle 136. In FIGS. 22 and 25, plates 137 are connected to boom 106 as shown in FIG. 22. A plurality of plates 138 attached to bar 139 with structural (for example, welded) connections. The plates 138 can be pinned to plates 137 as shown in FIG. 22 with pinned connections 140. End cap 141 can be structurally connected to bar 139 (for example, welded) and diagonal struts 142 for bracing and reinforcement. End cap 141 has plate 143 that functions as an anchor for diagonal brace 123, using shackle 136. End cap 141 also has plate 144 that forms an anchor for diagonal brace 123 using a shackle 136.

As with the embodiments of FIGS. 1–16, each apex 116, 117 can support rigging for lifting a package 23, vessel 59, or other multi-ton object. Such rigging can include slings 20, 21, 22, beam 19, slings 48 or any other suitable rigging such as the rigging illustrated in FIGS. 1–16.

A fifth embodiment of the preferred embodiment of the apparatus of the present invention is shown in FIGS. 29–35, designated generally by the numeral 10D in FIGS. 29–35. As with the preferred embodiment, the embodiment 10D of FIGS. 29–35 provides four booms 105, 106, 107 that are arranged in pairs. The booms 105, 107 are paired and connected with a pinned connection at apex 116. The booms 106, 108 are connected at a pinned connection defined by apex 117. The lower end portion of each boom 105, 106, 107, 108 is supported by a carriage 145 that travels upon a support such as rails 150. Carriage 145 has an upper deck 146. Each carriage 145 upper deck 146 has a boom support 148. Each boom support is pivotally attached to the upper deck 146 of its carriage 145. Each boom 105, 106, 107, 108 is pivotally attached at a pivot 107 to a boom support 148.

Figure 27:
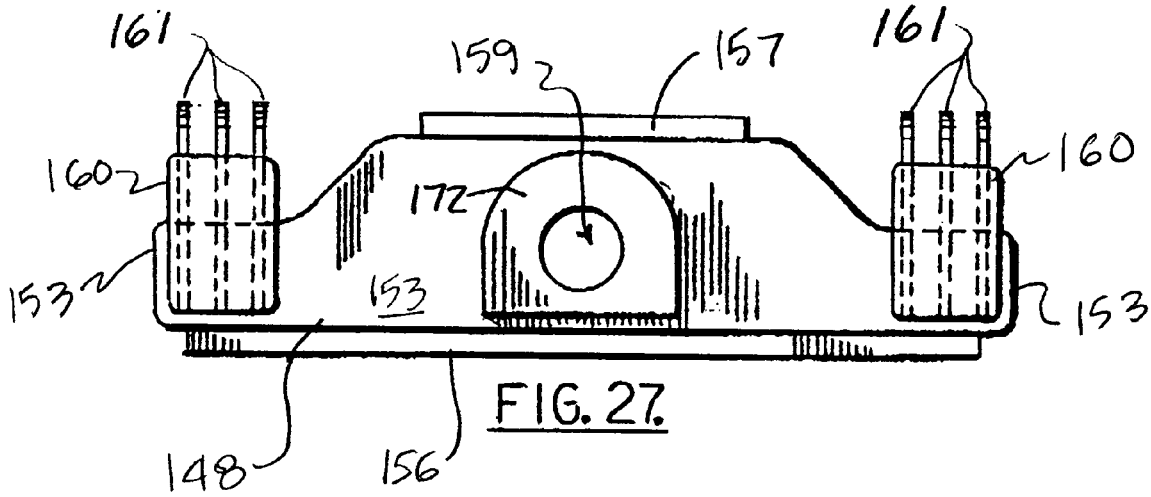
FIG. 27 is a fragmentary view of a fifth embodiment of the apparatus of the present invention.
Figure 28:
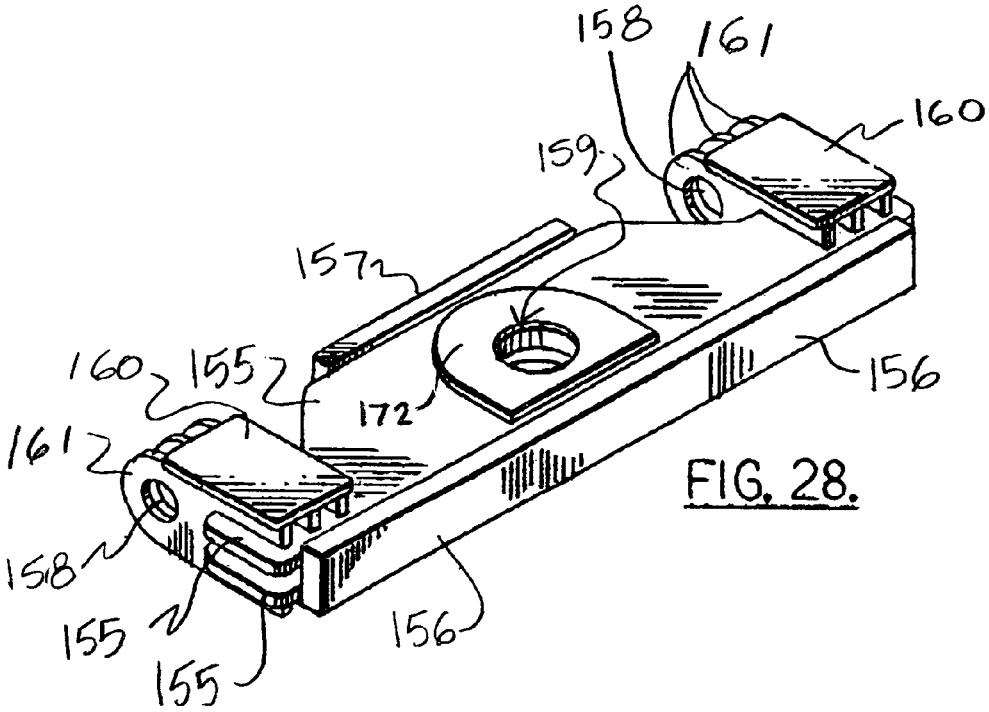
FIG. 28 is a fragmentary perspective view of the fifth embodiment of the apparatus of the present invention.
Figure 29:
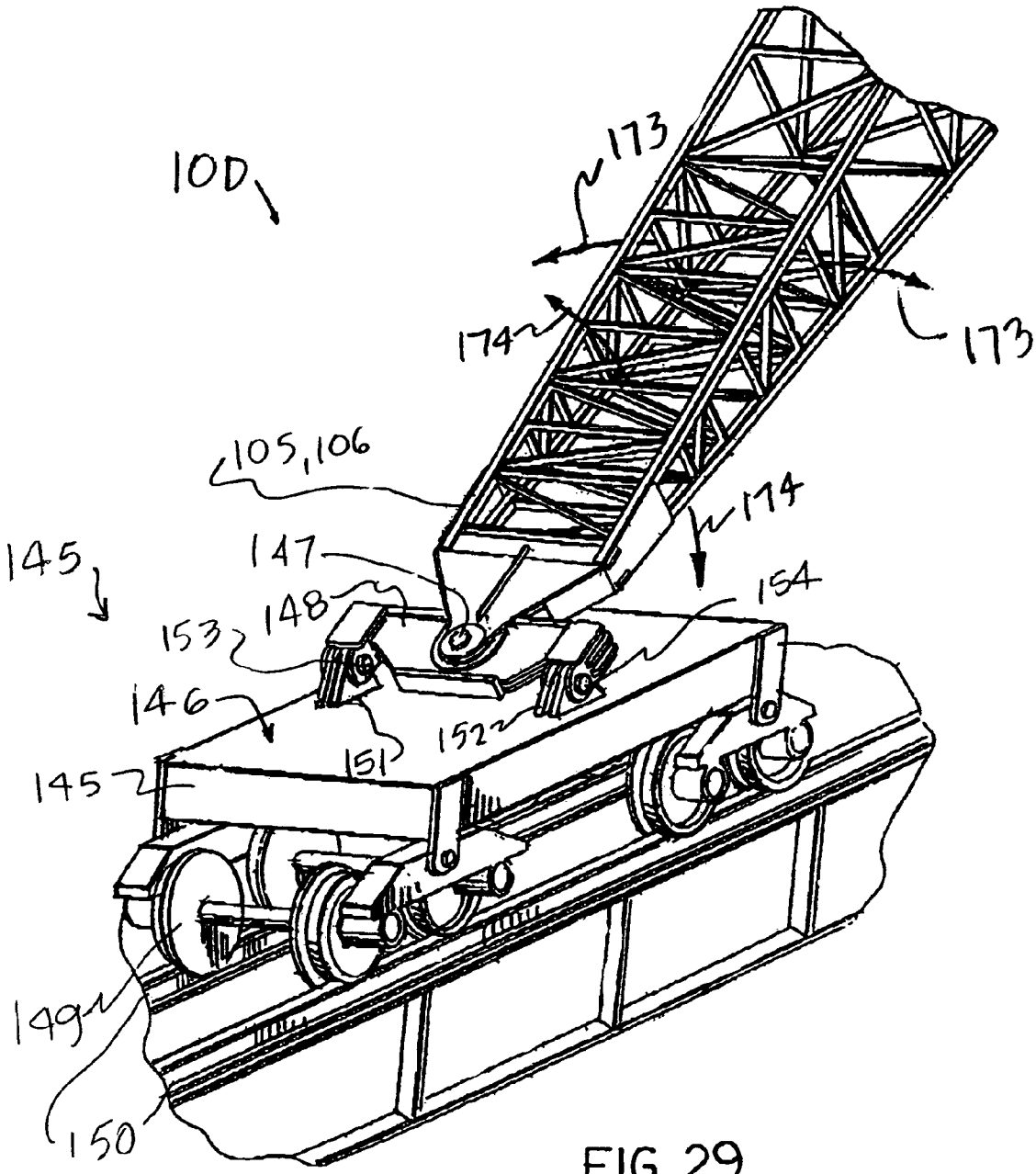
FIG. 29 is a perspective view of the fifth embodiment of the apparatus of the present invention.

In FIG. 29, a carriage 145 is shown supporting a boom 105 or 106. The carriage 145 has wheels 149 that are supported by rails 150. Each of the booms 105, 106, 107, 108 interfaces with a carriage 145 using a boom support 148 and a pair of spaced apart padeyes 151, 152 as shown in FIG. 29. In FIGS. 27–29, pinned connections 153, 154 define connections between boom support 148 and the padeyes 151, 152.

In FIGS. 27–28, each boom support 148 includes a main body that can be in the form of a pair of spaced apart plates 155. The plates 155 are spaced apart and connected using a plurality of plates welded thereto including front plate 156, heel plate 157, plates 160, and a plurality of plates 161, each having an opening 158. A pivot opening 159 in each of the plates 155 can be strengthened with plate 172. The lower end portion of each of the booms 105, 106 has an opening that can be aligned with openings 159 and boom support 148 for forming a pivotal connection that allows each boom, 105, 106 to pivot from left to right as indicated by arrow 173 in FIG. 29. Booms 105, 106, 107, 108 can also pivot as indicated by arrow 174 in FIG. 29 about pinned connections 153, 154.

In FIGS. 30–35, a sixth embodiment of the apparatus of the present invention is shown, designated generally by the numeral 10E in FIGS. 30–33 and 35.

Figure 31:
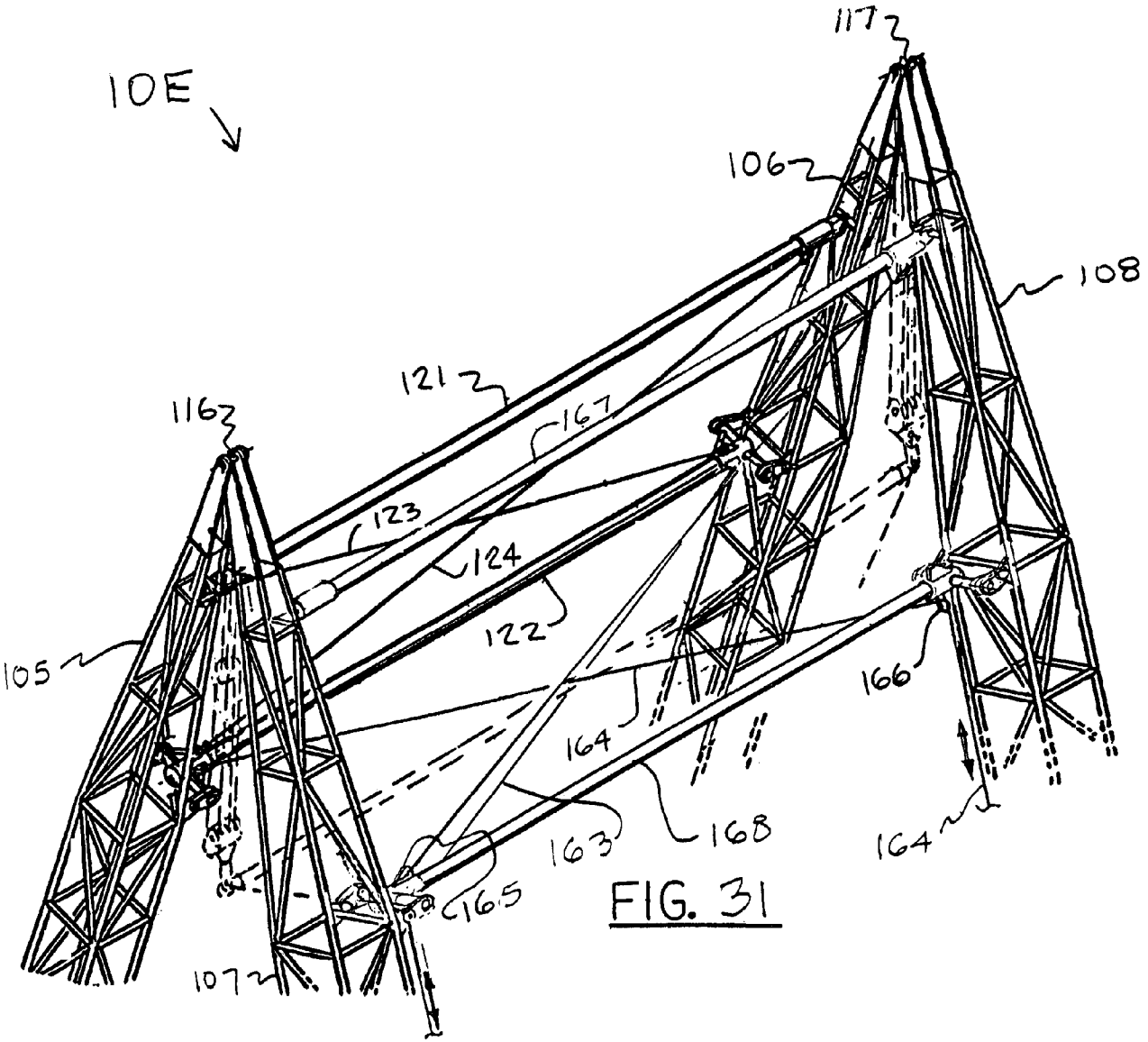
FIG. 31 is a perspective view of the sixth embodiment of the apparatus of the present invention.
Figure 32:
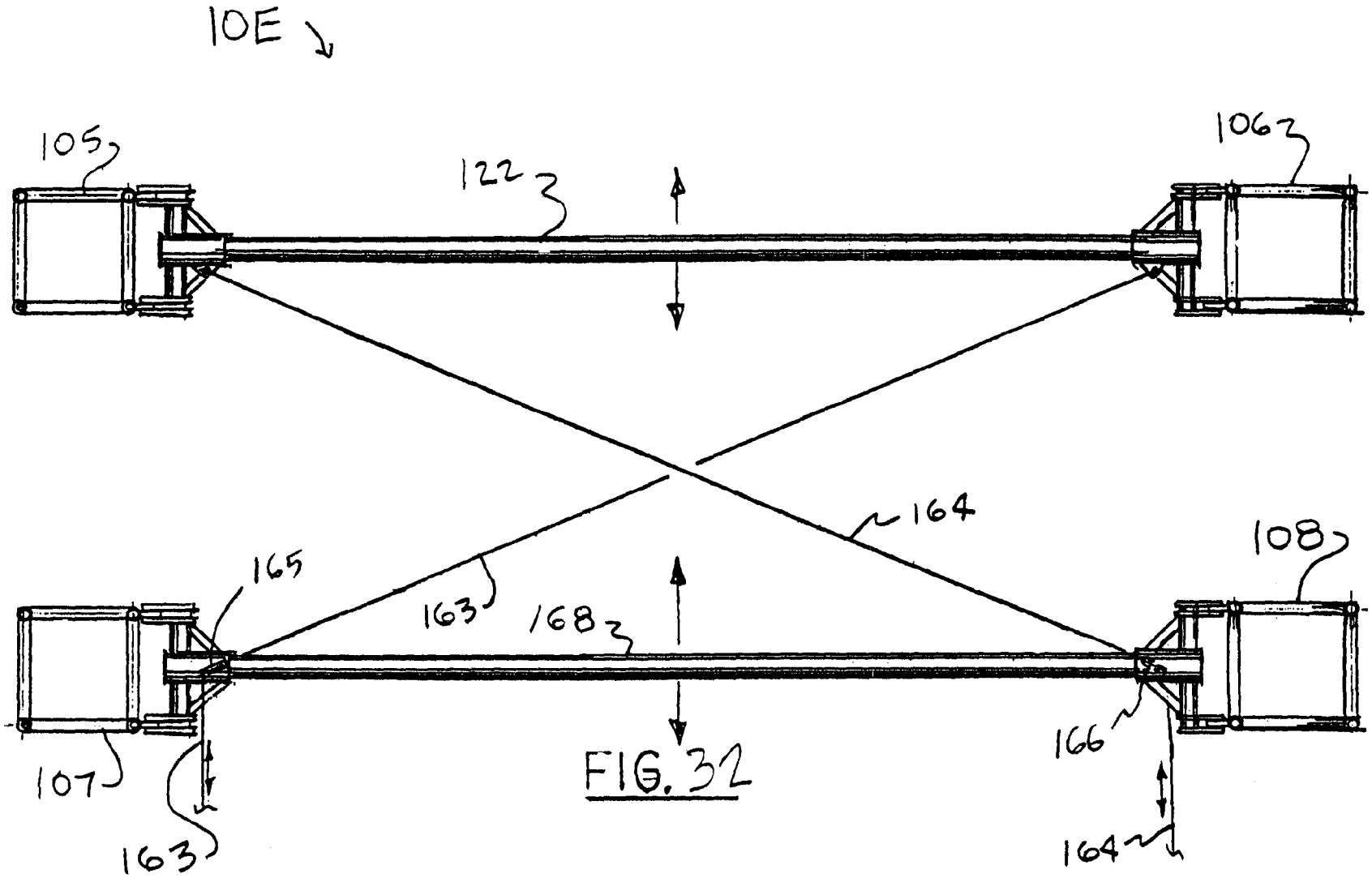
FIG. 32 is a sectional view taken along the line 32—32 of FIG. 30.
Figure 33:
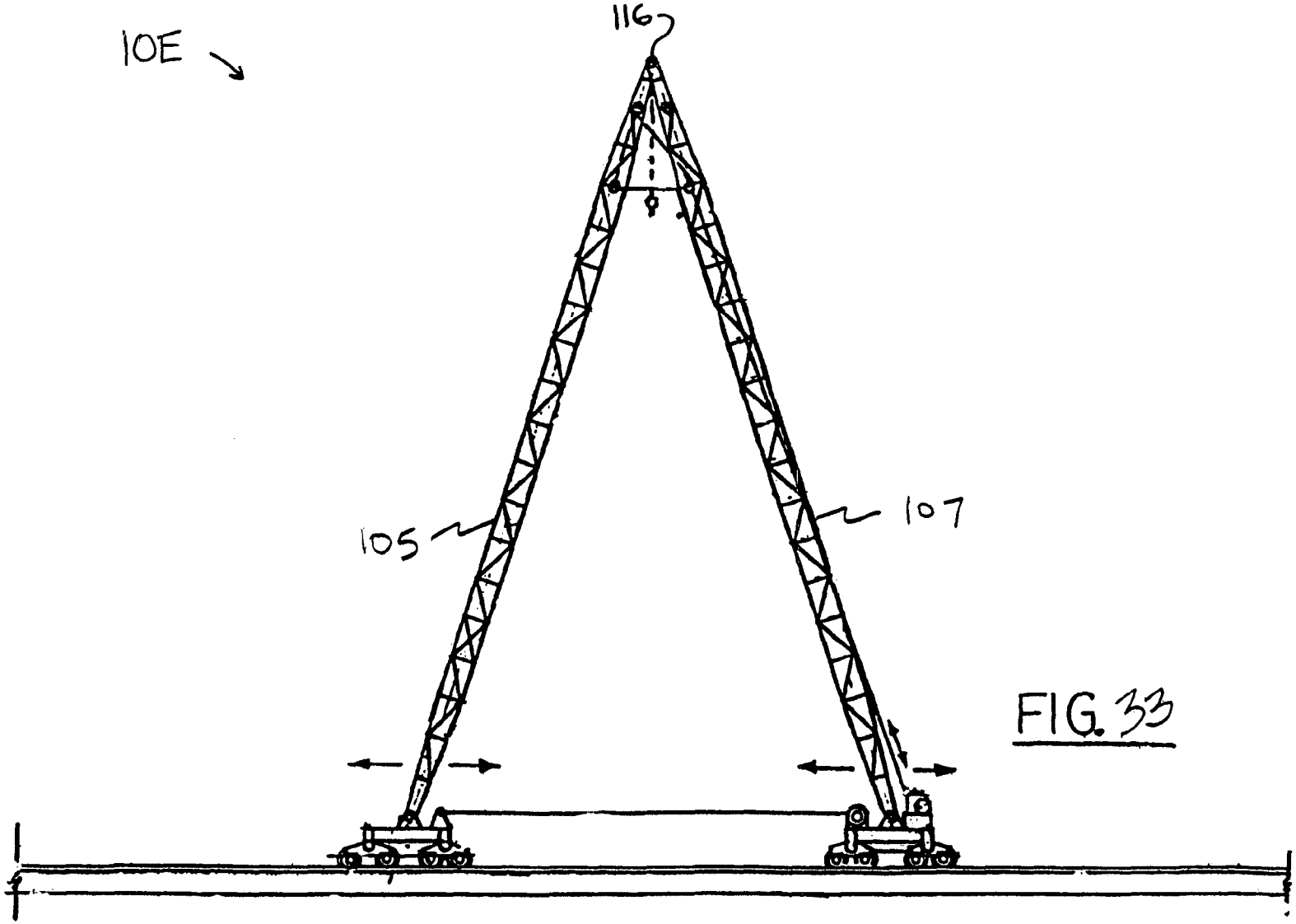
FIG. 33 is an elevation view of the sixth embodiment of the apparatus of the present invention.
Figure 34:
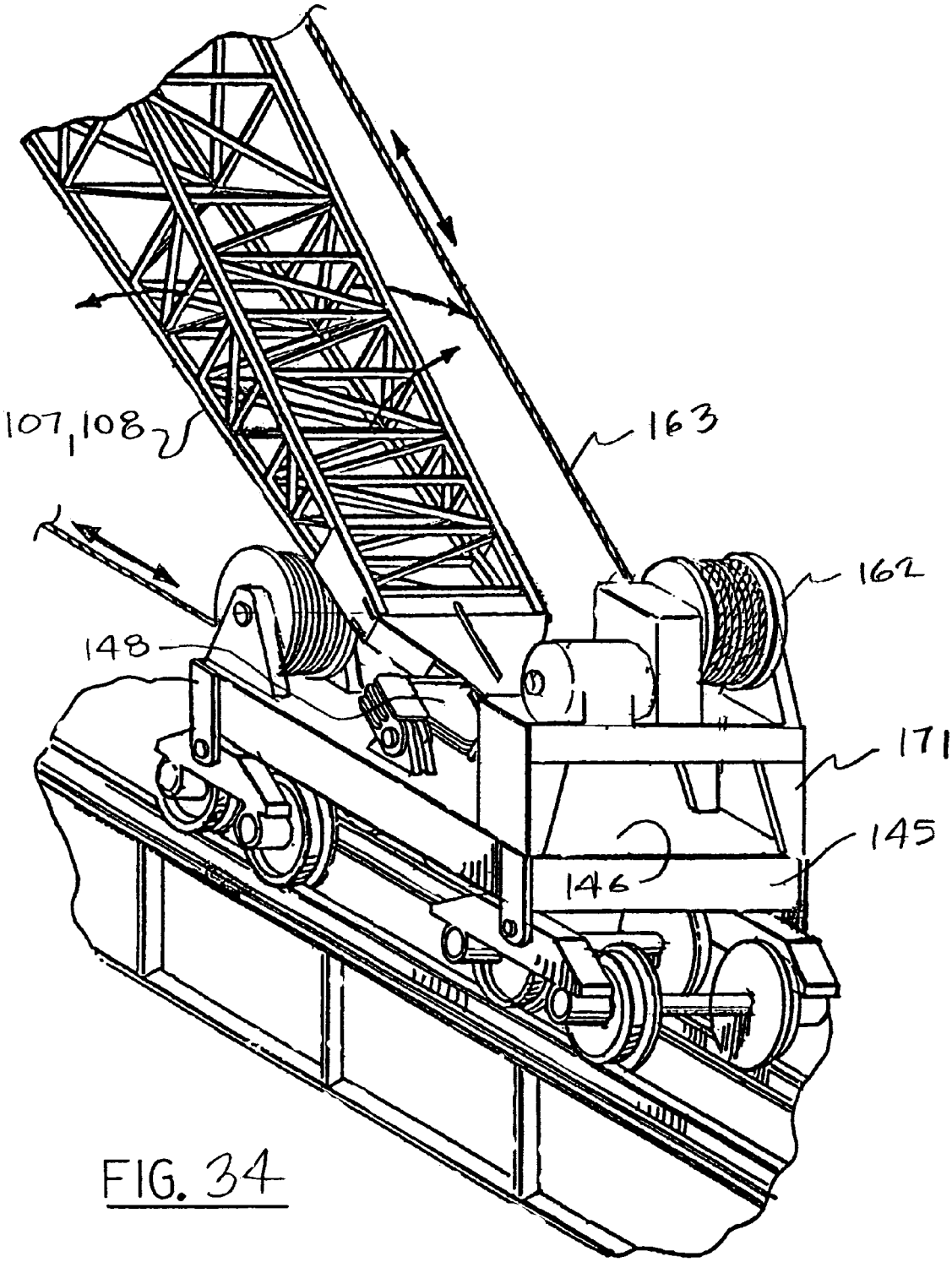
FIG. 34 is a perspective view of the sixth embodiment of the apparatus of the present invention.
Figure 35:
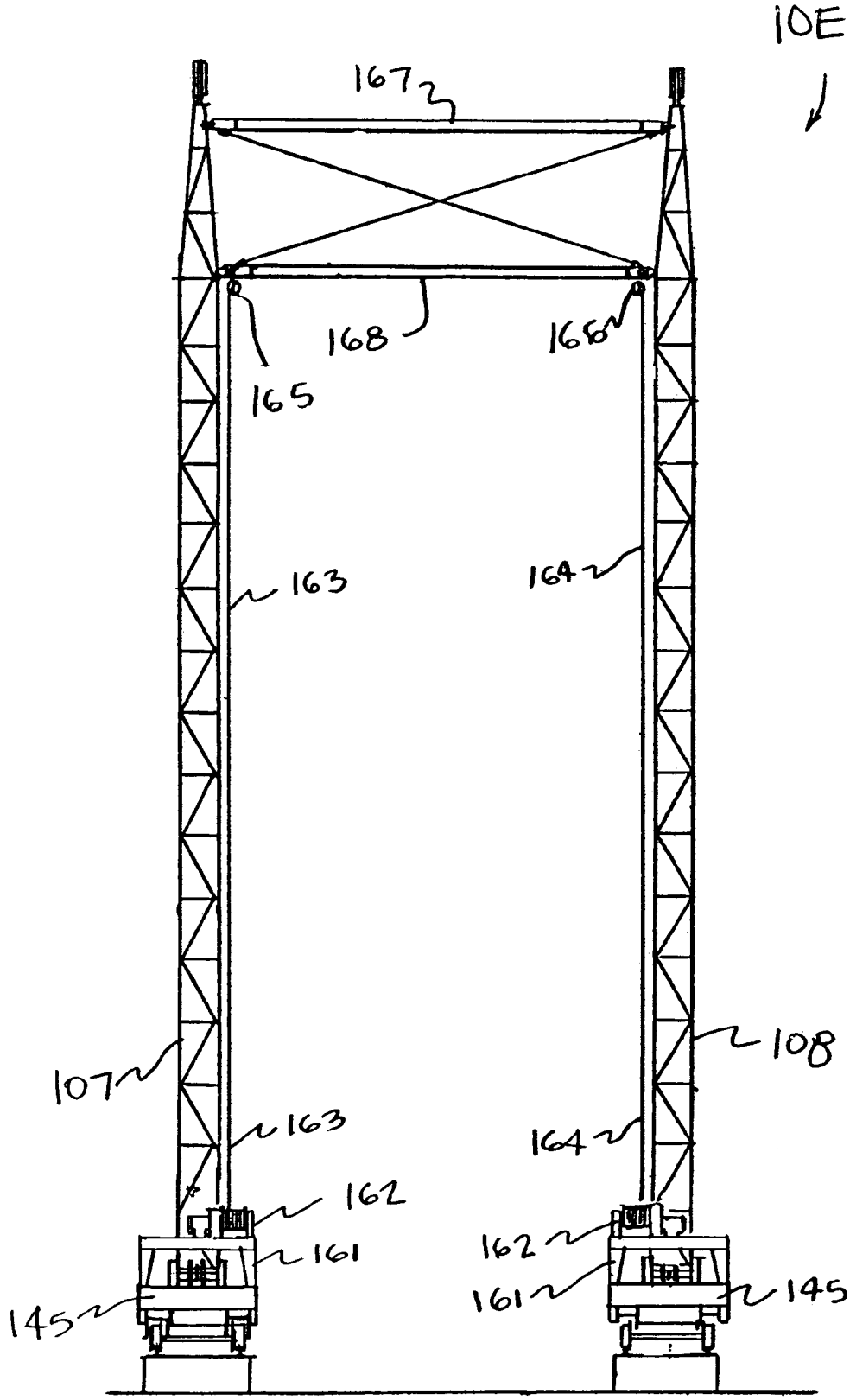
FIG. 35 is an elevation view of the sixth embodiment of the apparatus of the present invention.

Each of the booms 107, 108 has a carriage 145 that includes an upper deck 146 that supports winch pedestal 171 (FIG. 34). Winch pedestal 171 supports winch 162 that has a winch cable 163. In the drawings, the boom 107 has a winch 162 with winch cable 163. The boom 108 has a winch 162 with a winch cable 164 (FIG. 31). The winch cables 163, 164 extend upwardly along each boom 107, 108 respectively as shown in FIG. 35 to a position just below lower brace 168. At the intersection of lower brace 168 and boom 107, a pulley 165 is provided through which cable 163 passes. Similarly, cable 164 extends from winch 162 upwardly along the length of boom 108 to a position next to lower brace 168 and is rigged to pulley 166. In FIG. 32, the winch cable 163 extends from pulley 165 diagonally to boom 106 and connects to cross brace 122. Similarly, cable 164 extends through pulley 166 and then diagonally to boom 105 and connects to cross brace 122.

By using the winches 162 and their respective cables 163, 164 the length of the cables 163, 164 can be varied as the boom angles change. This produces a variable length tensile member that cross braces booms 106, 107 and booms 105, 108 as shown in FIGS. 31–32. Additionally, the pair of booms 105, 106 can be provided with upper and lower braces 121, 122. Booms 107, 108 can be provided with upper and lower cross braces 168, 168. Diagonal braces can be used in between booms 105, 106 and the upper and lower cross braces 121, 122. Similarly, diagonal braces can be used in between braces 107, 108 and spanning between upper and lower cross braces 167, 168.

Figure 30:
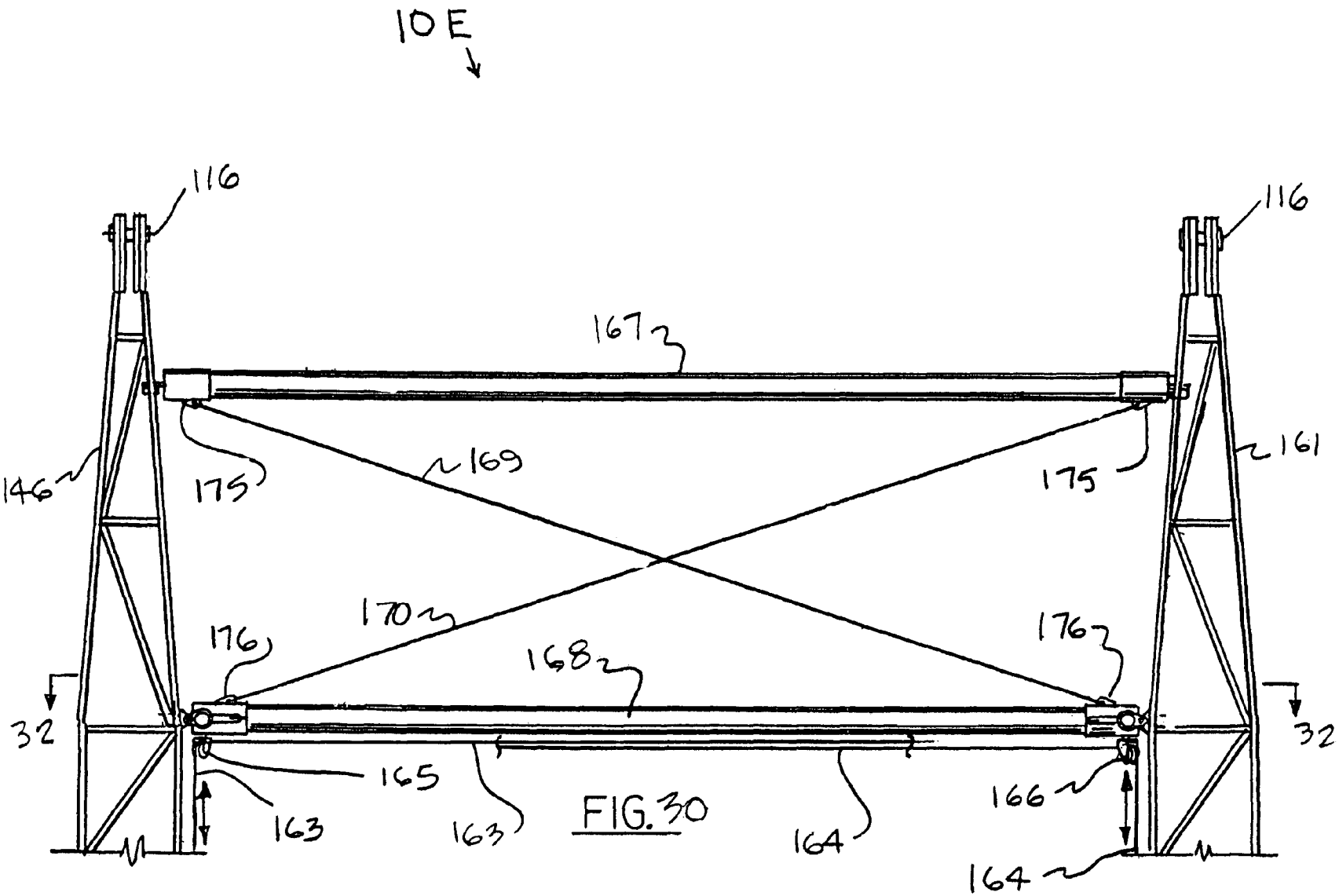
FIG. 30 is an elevation view of a sixth embodiment of the apparatus of the present invention.

This cross bracing arrangement can be seen, for example, in FIG. 30 wherein diagonally extending cross bracing cables 169, 170 are rigged to eyelets 175 on cross brace 167 and to eyelets 176 on cross brace 168. Similar cross bracing 123, 124 can be provided between booms 105, 106 and upper and lower cross braces 121, 122 as shown in FIG. 31 and as was shown and described with respect to the embodiments of FIGS. 1–28.

PARTS LIST

The following is a list of suitable parts and materials for the various elements of the preferred embodiment of the present invention.

| Part Number | Description |
|---|---|
| 10A | lifting apparatus |
| 10B | lifting apparatus |
| 10C | lifting apparatus |
| 10D | lifting apparatus |
| 10E | lifting apparatus |
| 11 | carriage |
| 12 | carriage |
| 13 | carriage |
| 14 | carriage |
| 15 | boom |
| 15A | upper end |
| 15B | upper end |
| 15C | longitudinal axis |
| 16 | boom |
| 17 | boom |
| 17A | upper end |
| 17B | upper end |
| 18 | boom |
| 19 | beam |
| 20 | sling |
| 21 | sling |
| 22 | sling |
| 23 | package |
| 24 | pinned connection |
| 24A | transverse pin |
| 25 | pinned connection |
| 26 | arrow |
| 27 | arrow |
| 28 | arrow |
| 29 | winch |
| 30 | motor drive |
| 31 | cable |
| 32 | arrow |
| 33 | sheave |
| 34 | sheave |
| 35 | chassis |
| 36 | upper surface |
| 37 | pinned connection |
| 38 | padeye |
| 39 | cable anchor |
| 40 | wheel |
| 41 | chassis |
| 42 | upper surface |
| 43 | padeye |
| 44 | pinned connection |
| 45 | rail |
| 46 | rail |
| 47 | crosstie |
| 48 | rigging |
| 49 | carriage |
| 50 | carriage |
| 51 | flat surface |
| 52 | tire |
| 53 | arrow |
| 54 | rollers |
| 55 | wooden base |
| 56 | metal plate |
| 59 | vessel |
| 60 | rail support |
| 61 | carriage |
| 62 | carriage |
| 63 | carriage |
| 64 | carriage |
| 65 | winch |
| 66 | boom |
| 67 | boom |
| 68 | boom |
| 69 | boom |
| 70 | cable |
| 71 | arrow |

-continued

| Part Number | Description |
|---|---|
| 72 | sheave |
| 73 | pinned connection |
| 74 | pinned connection |
| 75 | beam |
| 76 | beam |
| 77 | beam |
| 78 | beam |
| 79 | pinned connection |
| 80 | arrow |
| 81 | arrow |
| 82 | attachment |
| 83 | winch |
| 84 | load line |
| 85 | crown block |
| 86 | traveling block |
| 87 | end cap |
| 88 | shackle |
| 89 | sling |
| 90 | sling |
| 91 | sling |
| 92 | engine |
| 93 | hydraulic pumps |
| 94 | flow lines |
| R | roller |
| W | wheel |
| 100 | lifting apparatus |
| 101 | carriage |
| 102 | carriage |
| 103 | carriage |
| 104 | carriage |
| 105 | boom |
| 106 | boom |
| 107 | boom |
| 108 | boom |
| 109 | cable |
| 110 | winch |
| 111 | attachment |
| 112 | arrows |
| 113 | arrows |
| 114 | pinned connection |
| 115 | pinned connection |
| 116 | apex |
| 117 | apex |
| 118 | runway |
| 119 | runway |
| 120 | earth's surface |
| 121 | upper brace |
| 122 | lower brace |
| 123 | diagonal brace |
| 124 | diagonal brace |
| 125 | diagonal brace |
| 126 | diagonal brace |
| 127 | diagonal brace |
| 128A | diagonal brace |
| 128B | diagonal brace |
| 129 | padeye |
| 130 | padeye |
| 131 | plate |
| 132 | plate |
| 133 | pinned connection |
| 134 | end cap |
| 135 | plate |
| 136 | shackle |
| 137 | plate |
| 138 | plate |
| 139 | bar |
| 140 | pinned connection |
| 141 | end cap |
| 142 | diagonal strut |
| 143 | plate |
| 144 | plate |
| 145 | carriage |
| 146 | upper deck |
| 147 | pivot |
| 148 | boom support |
| 149 | wheel |
| 150 | rail |

-continued

| Part Number | Description |
|---|---|
| 151 | padeye |
| 152 | padeye |
| 153 | pinned connection |
| 154 | pined connection |
| 155 | plate |
| 156 | front plate |
| 157 | heel plate |
| 158 | opening |
| 159 | opening |
| 160 | plate |
| 161 | plate |
| 162 | winch |
| 163 | winch cable |
| 164 | winch cable |
| 165 | pulley |
| 166 | pulley |
| 167 | upper brace |
| 168 | lower brace |
| 169 | cable |
| 170 | cable |
| 171 | winch pedestal |
| 172 | plate |
| 173 | arrow |
| 174 | arrow |
| 175 | eyelet |
| 176 | eyelet |

The foregoing embodiments are presented by way of example only; the scope of the present invention is to be limited only by the following claims.

The invention claimed is:

1. A method for lifting a multi-ton package comprising the steps of:

a) supporting first and second booms respectively with first and second carriages, wherein the lower end portion of a first boom is pinned to said first carriage and the lower end portion of a second boom is pinned to said second carriage each boom having upper and lower end portions;

b) supporting third and fourth booms with third and fourth carriages, wherein the lower end portion of the third boom is pinned to the third carriage and the lower end portion of the fourth boom is pinned to the fourth carriage, each boom having upper and lower end portions;

c) pinning the upper end portion of the first and second booms together to define a pair of booms having a first boom apex;

d) pinning the upper end portion of the third and fourth booms together to define a a pair of booms having a second boom apex;

e) lifting the package with rigging that depends from the connected booms by tightening a first cable that links the first and second carriages and by tightening a second cable that links the third and fourth carriages, thus increasing the angle of inclination of the booms and raising each apex; and f) connecting a boom of the first pair to a boom of the second pair at positions next to a boom apex with a variable length member.

2. The method of claim 1 wherein the first and second booms occupy a first plane and the second and third booms occupy a second plane and further comprising the step of positioning the booms during a lift so that the first and second planes are generally parallel.

3. The method of claim 1 wherein some of the carriages have powered winches thereon and further comprising the step of powering the winches to tighten the cables during lifting in step "e".

4. The method of claim 1 wherein at least some of the carriages are wheeled.

5. The method of claim 1 further comprising the step of providing a winch and winch cable on at least one of the carriages to form part of the variable length member, and using the winch to shorten or lengthen the cable in between a boom and a carriage.

6. The method of claim 1 wherein each boom is an elongated linear structural boom member, and further comprising the step of gradually increasing the inclination of each boom during lifting.

7. The method of claim 1 further comprising the step of providing sheaves on each carriage and winding a cable about the sheaves on the first and second carriages multiple times, and on the third and fourth carriages multiple times.

8. The method of claim 1 further comprising the step of mounting each of the carriages on rail supports.

9. The method of claim 1 further comprising the step of supporting the beam with slings that depend from a boom apex.

10. A lifting apparatus for lifting a multi-ton package, comprising:

a) a plurality of carriages that define a structural base for supporting a load, at least some of the carriages being movable;

b) a truss supported by the plurality of carriages, the truss defining a load transfer between the carriages and the multi-ton package to be lifted;

c) the truss including multiple booms extending respectively from the plurality of carriages;

d) wherein a first pair of carriages of said plurality of carriages supports a first pair of said multiple booms with boom upper end portions that are connected together at a first boom apex;

e) wherein a second pair of carriages of said plurality of carriages supports a second pair of said multiple booms with boom upper end portions that are connected together at a second boom apex;

f) means for bringing the carriages and booms together so that the booms of the first pair increase in inclination during lifting; and g) a variable length cross brace member that spans between the upper end portion at least one boom of the first pair of booms and the upper end portion of at least one boom of the second pair of booms.

11. The lifting apparatus of claim 10 wherein at least some of the carriages are wheeled.

12. The lifting apparatus of claim 10 wherein the carriages are wheeled and further comprising tracks for supporting the wheeled carriages wherein the wheels engage and travel upon the tracks during use.

13. The lifting apparatus of claim 10 wherein the cross bracing members include at least one cross bracing truss.

14. The lifting apparatus of claim 10 wherein there are two cross bracing trusses attached to the booms at different respective elevational positions.

15. The lifting apparatus of claim 10 wherein one of the trusses is positioned next to the boom apex for each pair of booms.

16. The lifting apparatus of claim 10 wherein the cross bracing members include at least one cable.

17. The lifting apparatus of claim 16 further comprising a winch for taking up the variable length cable member.

18. The lifting apparatus of claim 10 wherein one of the cross brace members is a variable length cable that extends from the cross bracing to one of the booms at a position below the cross bracing.

19. The lifting apparatus of claim 10 wherein each variable length member carries tension during lifting.

20. The lifting apparatus of claim 10 wherein each variable length member is attached at one end portion to a carriage.

21. The lifting apparatus of claim 10 wherein each variable length member is attached at one end portion to a boom.

22. The lifting apparatus of claim 10 further comprising a sheave on the assembly of booms and carriages for increasing the mechanical advantage of each variable length member.

23. The lifting apparatus of claim 10 further comprising a plurality of sheaves on the carriages for increasing the mechanical advantage of each of the variable length members.

24. The lifting apparatus of claim 10 wherein the carriages and booms are land cranes, each land crane providing a carriage and a pivotally attached boom.

25. The lifting apparatus of claim 10 wherein each boom has at least one sheave and the tensile member is a flexible cable that is wound upon the sheaves, the cable having one end portion anchored to a carriage and another end portion that is wound upon the winch.

26. The lifting apparatus of claim 10 wherein a crown block and traveling block enable lifting and elevation change for the package in addition to the lifting elevation change achieved by changing inclination of the booms.

27. A lifting apparatus for lifting multi-ton packages, comprising:

a) a plurality of booms including a first pair of booms and a second pair of booms, each pair of booms having lower boom end portions, and upper boom end portions that are pinned together at a pinned connection defining a boom apex;

b) a first ground engaging interface that supports the first pair of booms and that includes a variable length tensile member that enables the lower end portions of the first pair of booms to be pulled together and thereby elevate the apex of the first pair of booms;

c) a second ground engaging interface that supports the second pair of booms and that includes a variable length tensile member that enables the lower end portions of the second pair of booms to be pulled together and thereby elevate the apex of the second pair of booms;

d) each ground engaging interface including movable carriages that enable the lower end portions of the booms of each pair to travel toward and away from each other during a lift;

e) rigging that extends between the booms and the package to be lifted;

f) cross bracing that extends between a boom of the first pair and a boom of the second pair; and g) the cross bracing including one or more variable length cross braces.

28. The lifting apparatus of claim 27 wherein the carriages are wheeled.

29. The lifting apparatus of claim 27 wherein the load transfer carriages comprise at least one carriage with a powered winch thereon, and the tensile member is a cable that is wound upon the powered winch.

30. The lifting apparatus of claim 27 wherein the rigging includes at least one lifting beam and a plurality of slings extending between the lifting beam and the booms.

31. The lifting apparatus of claim 30 wherein the beam is suspended from the first and second pinned connections.

32. The lifting apparatus of claim 30 wherein the beam is suspended from a pair of slings that are attached to the first and second pinned connections respectively.

33. The lifting apparatus of claim 32 wherein the slings are flexible slings.

34. The lifting apparatus of claim 30 wherein there are a plurality of lifting beams and the rigging includes a crown block and a traveling block on adjacent beams wound with cable.

35. The lifting apparatus of claim 27 wherein two of the carriages have a pair of winches thereon, one winch for changing the length of a variable length tensile member, the other winch having a load line wound thereon for shortening a portion of the rigging prior to or during a lift.

36. The lifting apparatus of claim 27 wherein the plurality of carriages include four carriages, each carriage holding the lower end portion of a boom.

37. The lifting apparatus of claim 27 wherein the plurality of carriages include four carriages, each carriage holding the lower end portion of a boom at a pinned connection between the boom and the carriage.

38. The lifting apparatus of claim 27 wherein the cross bracing includes at least one flexible cable.

39. The lifting apparatus of claim 27 wherein the cross bracing includes at least one transverse beam.

40. The lifting apparatus of claim 27 wherein each boom has at least one sheave and the tensile member is a flexible cable that is rigged upon the sheaves, the cable having one end portion anchored to a carriage and another end portion that is wound upon the winch.

41. The lifting apparatus of claim 27 wherein each boom has at least one sheave and the tensile member is a flexible cable that is wound upon the sheaves, the cable having one end portion anchored to a carriage and another end portion that is wound upon the winch.

42. The lifting apparatus of claim 27 wherein a crown block and traveling block enable lifting and elevation change for the package in addition to the lifting elevation change achieved by changing inclination of the booms.

43. A lifting apparatus for lifting multi-ton objects, comprising:

a) a first lifting truss having an apex, the first truss including a pair of booms, each with an upper boom end portion, said end portions being connected together at an apex;

b) a second lifting truss having an apex, the second truss including a pair of booms, each with an upper boom end portion, said end portions being connected together at an apex;

c) each of the trusses including a load transfer interface at the respective lower end portions of the trusses for providing a load transfer interface between the trusses and an underlying support surface, each lifting truss including a variable length tensile member that can pull the booms together, elevating its apex;

d) multiple cross bracing connections that span between booms and that includes one or more variable length cross braces that extends between two booms of different of the trusses; and e) at least one of the cross bracing connections spanning between the trusses near the upper end portions thereof.

44. The lifting apparatus of claim 43 further comprising rigging that is supported by and that extends from the trusses including a lifting beam and cabling below the lifting beam and in between the lifting beam and the object to be lifted.

45. The lifting apparatus of claim 44 wherein the rigging includes multiple, generally horizontally extended beams.

46. The lifting apparatus of claim 45 wherein the rigging includes upper and lower beams positioned at different elevations with respect to each other.

47. The lifting apparatus of claim 46 wherein there are a pair of respective upper beams depending from the first and second upper connections.

48. The lifting apparatus of claim 43 wherein each boom has at least one sheave and the tensile member is a flexible cable that is wound upon the sheaves, the cable having one end portion anchored to a carriage and another end portion that is wound upon the winch.

49. The lifting apparatus of claim 43 wherein a crown block and traveling block enable lifting and elevation change for the package in addition to the lifting elevation change achieved by changing inclination of the booms.

50. A lifting apparatus for lifting multi-ton packages, comprising:

a) a plurality of booms including a first pair of booms and a second pair of booms, each pair of booms having lower boom end portions, and upper boom end portions that are pinned together at a pinned connection defining a boom apex;

b) a first ground engaging interface that supports the first pair of booms and that includes a variable length tensile member that enables the lower end portions of the first pair of booms to be pulled together and thereby elevate the apex of the first pair of booms;

c) a second ground engaging interface that supports the second pair of booms and that includes a variable length tensile member that enables the lower end portions of the second pair of booms to be pulled together and thereby elevate the apex of the second pair of booms;

d) rigging that extends between the booms and the package to be lifted; and e) variable length cross bracing that extends between a boom of the first pair and a boom of the second pair.

51. The lifting apparatus of claim 50 wherein the variable length cross bracing is a cable that is wound upon a winch, the winch being anchored to one of the carriages.

* * * * *